US011645887B2

(12) United States Patent
Cohen et al.

(10) Patent No.: US 11,645,887 B2
(45) Date of Patent: May 9, 2023

(54) MISSION FUNCTIONALITY

(71) Applicants: Alex Cohen, Barcelona (ES); Stephen Cutler, Bibice Zielonki (PL)

(72) Inventors: Alex Cohen, Barcelona (ES); Stephen Cutler, Bibice Zielonki (PL)

(73) Assignee: KALAMBA GAMES LTD

( * ) Notice: Subject to any disclaimer, the term of this patent is extended or adjusted under 35 U.S.C. 154(b) by 198 days.

(21) Appl. No.: 16/538,064

(22) Filed: Aug. 12, 2019

(65) Prior Publication Data

US 2019/0362597 A1 Nov. 28, 2019

Related U.S. Application Data

(62) Division of application No. 15/883,311, filed on Jan. 30, 2018.

(60) Provisional application No. 62/454,079, filed on Feb. 3, 2017.

(51) Int. Cl.
*G07F 17/32* (2006.01)
*G07C 15/00* (2006.01)

(52) U.S. Cl.
CPC ..... *G07F 17/3255* (2013.01); *G07C 15/006* (2013.01); *G07F 17/323* (2013.01); *G07F 17/3213* (2013.01); *G07F 17/3227* (2013.01); *G07F 17/3239* (2013.01); *G07F 17/3251* (2013.01); *G07F 17/3258* (2013.01); *G07F 17/3262* (2013.01); *G07F 17/3267* (2013.01); *G07F 17/3269* (2013.01); *G07F 17/3288* (2013.01)

(58) Field of Classification Search
None
See application file for complete search history.

(56) References Cited

U.S. PATENT DOCUMENTS

| | | | | | |
|---|---|---|---|---|---|
| 5,823,879 | A * | 10/1998 | Goldberg | G06Q 30/0207 | 463/42 |
| 2003/0060277 | A1* | 3/2003 | Webb | G07F 17/3211 | 463/25 |
| 2007/0099694 | A1* | 5/2007 | McCarthy | G07F 17/323 | 463/24 |
| 2007/0294089 | A1* | 12/2007 | Garbow | G06Q 30/0216 | 705/26.1 |
| 2009/0082088 | A1* | 3/2009 | Anderson | G07F 17/32 | 463/20 |
| 2009/0117989 | A1* | 5/2009 | Arezina | G07F 17/32 | 463/20 |
| 2012/0115581 | A1* | 5/2012 | Englman | G07F 17/3258 | 463/25 |

* cited by examiner

*Primary Examiner* — Kevin Y Kim
(74) *Attorney, Agent, or Firm* — CF3; Stephen Eisenmann

(57) ABSTRACT

This disclosure relates to devices, systems, and methods include an electronic gaming device management system including a memory including one or more promotional gaming structures, one or more processors configured to implement the one or more promotional gaming structures, where the one or more promotional gaming structures includes a first promotional gaming structure relating to a first gaming site.

8 Claims, 33 Drawing Sheets

CONGRATS YOU COMPLETED MISSION

DO YOU WANT TO DO BONUS GAME?

DO YOU WANT TO STORE TO ADVANCE TO BIGGER BONUS GAMES?

MISSION FUNCTIONALITY

CROSS-REFERENCE TO RELATED APPLICATIONS

This application claims priority to and is a divisional application of U.S. patent application Ser. No. 15/883,311, entitled "Mission Functionality", filed on Jan. 30, 2018 which claims priority to US Provisional Patent Application Ser. No. 62/454,079 filed on Feb. 3, 2017 which are all hereby incorporated in their entireties herein by reference.

BACKGROUND

Field

The subject matter disclosed herein relates to an electronic gaming system. More specifically, the disclosure relates to providing one or more mission and promotional functionalities in an electronic gaming system. For example, an online system may have the components of: client device (a PC or mobile device, or even an electronic gaming machine such as a lottery terminal) where the game is displayed and where user interaction is received; client software, which is either preloaded on the client device or downloaded when the user initiates the game; a network connection, such as the internet, over which content, user interaction, and game results are sent; server hardware; server software which processes game results for individual bets; a database or other repository of persisted game, user, configuration, and promotional award data; and an account management system, which stores player information such as cash available and identity information (name, address, etc.).

Information

The gaming industry has numerous gaming entities where players can play various games. Further, numerous gaming entities have one or more online (e.g., non-physical) locations on the internet and/or worldwide web and/or mobile gaming applications (e.g., hand held computers, notebook, etc.), along with physical locations. A client of a casino or other gaming entity can gamble via various games of chance. For example, craps, roulette, baccarat, blackjack, and electronic games (e.g., a slot machine) are games of chance where a person may gamble on an outcome.

Clients can also use slot machine type games. Paylines of an electronic gaming device (e.g., a slot machine, computer, hand held device, mobile phone, etc.) are utilized in game play. For example, one way utilized to determine when predetermined winning symbol combinations are aligned in a predetermined pattern to form a winning combination can be accomplished via paylines. A winning event occurs when the player successfully matches the predetermined winning symbols in one of the predetermined patterns.

A player's entertainment while playing one or more games may be enhanced by utilizing one or more mission and/or promotional functionalities on one or more devices in the electronic gaming system. By increasing the player's entertainment level, the player's enjoyment of the game may be enhanced, which may increase a player's game playing period. Further, promotional functionalities utilized with the mission functionality can increase the profitability of a gaming entity.

BRIEF DESCRIPTION OF THE FIGURES

Non-limiting and non-exhaustive examples will be described with reference to the following figures, wherein like reference numerals refer to like parts throughout the various figures.

DETAILED DESCRIPTION

Figure 1:
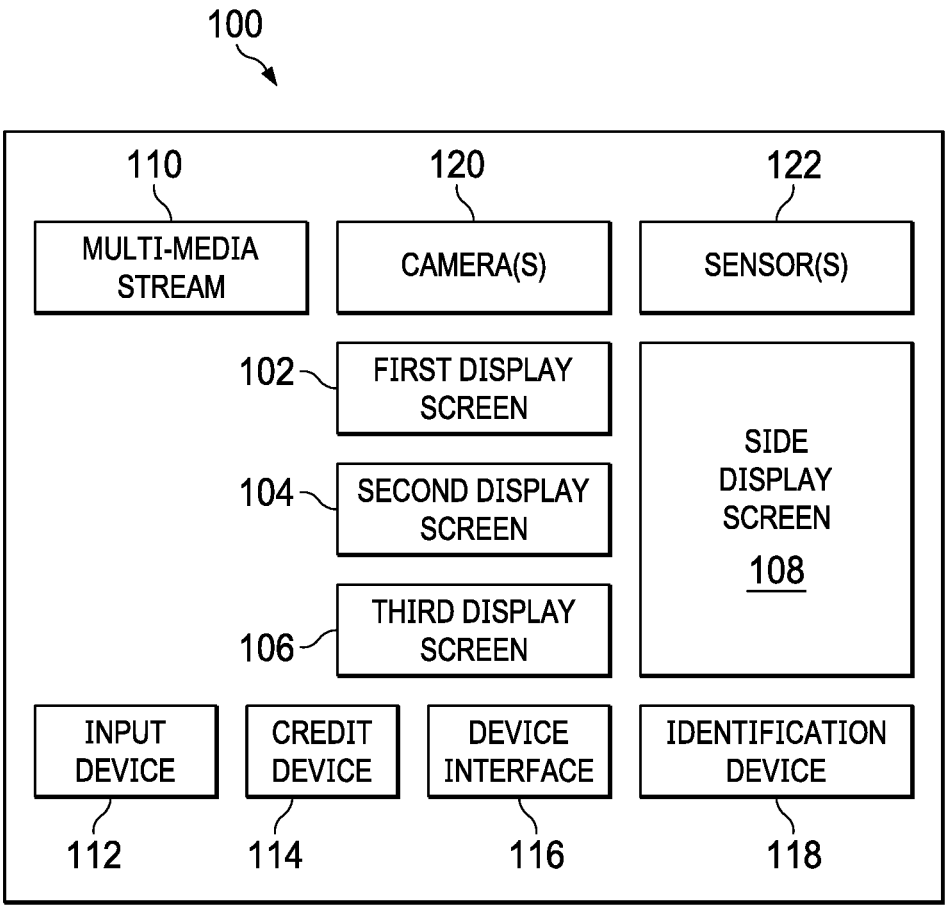
FIG. 1 is an illustration of the electronic gaming device, according to one embodiment.

FIG. 1 is an illustration of an electronic gaming device 100. Electronic gaming device 100 may include a multi-media stream 110, a first display screen 102, a second display screen 104, a third display screen 106, a side display screen 108, an input device 112, a credit device 114, a device interface 116, and an identification device 118. Electronic gaming device 100 may display one, two, a few, or a plurality of multi-media streams 110, which may be obtained from one or more gaming tables, one or more electronic gaming devices, a central server, a video server, a music server, an advertising server, another data source, and/or any combination thereof.

Multi-media streams may be obtained for an entertainment event, a wagering event, a promotional event, a promotional offering, an advertisement, a sporting event, any other event, and/or any combination thereof. For example, the entertainment event may be a concert, etc. In another example, the wagering event may be a poker tournament, a horse race, and/or any combination thereof. The advertisement may be an advertisement for a casino, a restaurant, a mission promotion.

Input device 112 may be mechanical buttons, electronic buttons, mechanical switches, electronic switches, optical switches, a slot pull handle, a keyboard, a keypad, a touch screen, a gesture screen, a joystick, a pointing device (e.g., a mouse), a virtual (on-screen) keyboard, a virtual (on-screen) keypad, biometric sensor, or any combination thereof. Input device 112 may be utilized to select one or more mission gaming options, to make a wager, to make a mission wager, to control any object, to select one or more mission gaming options, to obtain data relating to historical payouts, to modify electronic gaming device 100 (e.g., change sound level, configuration, font, language, etc.), and/or to select a movie or song, to select live multi-media streams, to request services (e.g., drinks, slot attendant, manager, etc.). Input device 112 may be any control panel.

Credit device 114 may be utilized to collect monies and distribute monies (e.g., cash, vouchers, etc.). Credit device 114 may interface with a mobile device to electronically transmit money and/or credits. Credit device 114 may interface with a player's card to exchange player points.

Device interface 116 may be utilized to interface electronic gaming device 100 to a bonus game device, a local area progressive controller, a wide area progressive controller, a progressive sign controller, a peripheral display device, signage, a promotional device, network components, a local network, a wide area network, remote access equipment, a slot monitoring system, a slot player tracking system, the Internet, a server, and/or any combination thereof.

Device interface 116 may be utilized to connect a player to electronic gaming device 100 through a mobile device, card, keypad, identification device 118, and/or any combination thereof. Device interface 116 may include a docking station by which a mobile device is plugged into electronic gaming machine 100. Device interface 116 may include an over the air connection by which a mobile device is connected to electronic gaming machine 100 (e.g., Bluetooth, Near Field technology, and/or Wi-Fi technology). Device interface 116 may include a connection to identification device 118.

Identification device 118 may be utilized to determine an identity of a player. Based on information obtained by identification device 118, electronic gaming device 100 may be reconfigured. For example, the language, sound level, music, placement of multi-media streams, and/or one or more game functionalities (e.g., game type 1, game type 2, game type 3, etc.) may be presented.

Identification device 118 may utilize biometrics (e.g., thumb print, retinal scan, or other biometric). Identification device 118 may include a card entry slot into input device 112. Identification device 118 may include a keypad with an assigned pin number for verification. Identification device 118 may include multiple layers of identification for added security. For example, a player could be required to enter a player tracking card, and/or a pin number, and/or a thumb print, and/or any combination thereof. Based on information obtained by identification device 118, electronic gaming device 100 may be reconfigured. For example, the language, sound level, music, placement of video streams, placement of images, and the placement of gaming options utilized may be modified based on a player's preference data.

First display screen 102 may be a liquid crystal display ("LCD"), a cathode ray tube display ("CRT"), organic light-emitting diode display ("OLED"), plasma display panel ("PDP"), electroluminescent display ("ELD"), a light-emitting diode display ("LED"), or any other display technology. First display screen 102 may be used for displaying primary games or secondary (bonus) games. Second display screen 104, third display screen 106, side display screen 108, and any other screens may utilize the same technology as first display screen 102 and/or any combination of technologies.

First display screen 102 may also be virtually combined with second display screen 104. Likewise second display screen 104 may also be virtually combined with third display screen 106. First display screen 102 may be virtually combined with both second display screen 104 and third display screen 106. Any combination thereof may be formed.

For example, a single large image could be partially displayed on second display screen 104 and partially displayed on third display screen 106, so that when both display screens are put together they complete one image. Electronic gaming device 100 may stream or play prerecorded multi-media data, which may be displayed on any display combination.

One or more cameras 120 and/or one or more sensors 122 may be utilized as one or more depth image sensing devices, which may be located in various locations, including but not limited to, above the base display, above second display, in one or more locations on gaming cabinet front, on a side of the gaming cabinet other than gaming cabinet front, and/or any other location.

Electronic gaming device 100 may include at least one display device. Electronic gaming device 100 may include a base display and/or a second display. In one embodiment, base display may be the primary display for a first game and/or one or more mission games. In another embodiment, second display may be the primary display for a second, bonus game, and/or one or more mission games. In one embodiment, base display and second display may display separate portions of a common image. For example, second display may display a top portion of a wheel spinning while base display may display the bottom portion of the same wheel spinning.

Figure 2:
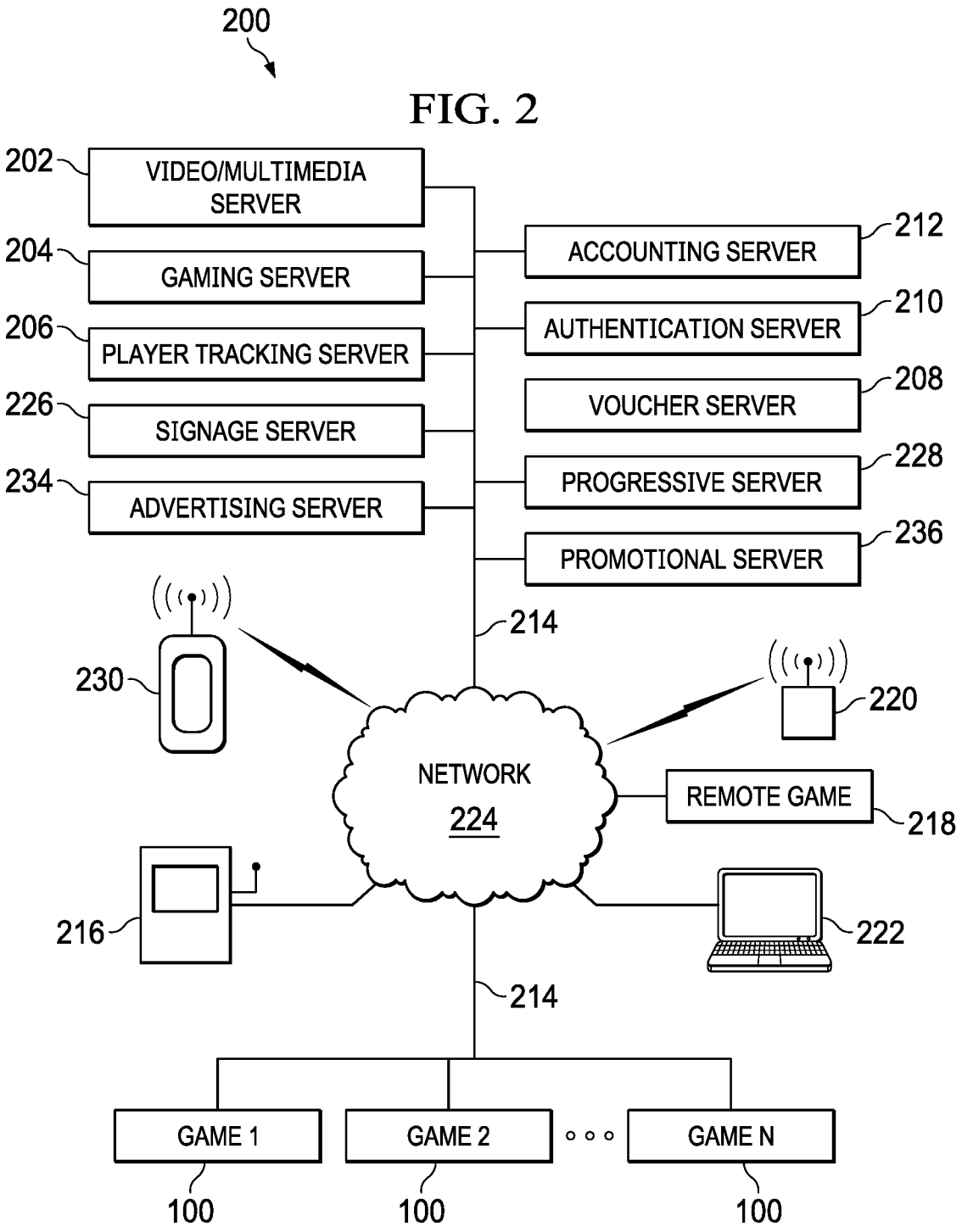
FIG. 2 is an illustration of an electronic gaming system, according to one embodiment.

In FIG. 2, an electronic gaming system 200 is shown. Electronic gaming system 200 may include a video/multimedia server 202, a gaming server 204, a player tracking server 206, a voucher server 208, an authentication server 210, and an accounting server 212.

Electronic gaming system 200 may include video/multimedia server 202, which may be coupled to network 224 via a network link 214. Network 224 may be the Internet, a private network, and/or a network cloud. One or more video streams may be received at video/multimedia server 202 from other electronic gaming devices 100. Video/multimedia server 202 may transmit one or more of these video streams to a mobile phone 230, electronic gaming device 100, a remote electronic gaming device at a different location in the same property 216, a remote electronic gaming device at a different location 218, a laptop 222, and/or any other remote electronic device 220. Video/multimedia server 202 may transmit these video streams via network link 214 and/or network 224.

For example, a remote gaming device at the same location may be utilized at a casino with multiple casino floors, a casino that allows wagering activities to take place from the hotel room, a casino that may allow wagering activities (including stacking wagers) to take place from the pool area, etc. In another example, the remote devices may be at another location via a progressive link to another casino, and/or a link within a casino corporation that owns numerous casinos (e.g., MGM, Caesars, etc.).

Gaming server 204 may generate gaming outcomes. Gaming server 204 may provide electronic gaming device 100 with game play content. Gaming server 204 may provide electronic gaming device 100 with game play math and/or outcomes. Gaming server 204 may provide one or more of: a mission game feature functionality; a mission game feature evaluation functionality; a payout functionality; a base and/or bonus game play functionality; a base and/or bonus game play evaluation functionality, other game functionality, and/or any other virtual game functionality.

Player tracking server 206 may track a player's betting activity, a player's preferences (e.g., language, font, sound level, drinks, etc.). Based on data obtained by player tracking server 206, a player may be eligible for gaming rewards (e.g., free play), promotions, and/or other awards (e.g., complimentary food, drinks, lodging, concerts, etc.).

Voucher server 208 may generate a voucher, which may include data relating to gaming. Further, the voucher may include mission wagering data and/or payline structure option selections.

Authentication server 210 may determine the validity of vouchers, player's identity, and/or an outcome for a gaming event.

Accounting server 212 may compile, track, and/or monitor cash flows, voucher transactions, winning vouchers, losing vouchers, mission wagering data, and/or other transaction data. Transaction data may include the number of wagers, the size of these wagers, the date and time for these wagers, the identity of the players making these wagers, the frequency of the wagers, and/or verification data, and/or confirmation data. Accounting server 212 may generate tax information relating to these wagers. Accounting server 212 may generate profit/loss reports for players' tracked outcomes.

Network connection 214 may be used for communication between dedicated servers, thin clients, thick clients, back-office accounting systems, etc.

Laptop computer 222 and/or any other electronic devices (e.g., mobile phone 230, electronic gaming device 100, etc.) may be used for downloading new gaming device applications or gaming device related firmware through remote access.

Laptop computer 222 and/or any other electronic device (e.g., mobile phone 230, electronic gaming device 100, etc.) may be used for uploading accounting information (e.g., cashable credits, non-cashable credits, coin in, coin out, bill in, voucher in, voucher out, etc.).

Network 224 may be a local area network, a casino premises network, a wide area network, a virtual private network, an enterprise private network, the Internet, or any combination thereof. Hardware components, such as network interface cards, repeaters and hubs, bridges, switches, routers, firewalls, or any combination thereof may also be part of network 224.

A statistics server may be used to maintain data relating to historical game play and/or mission wagering data for one or more electronic gaming devices 100 and/or other events. This historical data may include winning amounts, winning data (e.g., person, sex, age, time on machine, amount of spins before winning event occurred, etc.), fastest winning event reoccurrence, longest winning event reoccurrence, average frequencies of winning events, average winning amounts, highest winning amount, lowest winning amount, locations for winning events, winning event dates, winning machines, winning game themes, mission awards, status of missions, any other mission data, and/or any other data relating to game play.

Searching server may implement a search on one or more gaming devices to obtain gaming data. Searching server may implement a messaging function, which may transmit a message to a third party (e.g., a player) relating to a search, a search status update, a game status update, a wager status update, a confirmation of a wager, a confirmation of a money transfer, and/or any other data relating to the player's account. The message can take the form of a text display on the gaming device, a pop up window, a text message, an email, a voice message, a video message and the like. Searching server may implement a wagering function, which may be an automatic wagering mechanism. These functions of searching server may be integrated into one or more servers.

Searching server may include one or more searching structures, one or more searching algorithms, and/or any other searching mechanisms. In general, the search structures may cover which EGMs paid out the most money during a time period, which EGMs kept the most money from players during a time period, which EGMs are the most popular (e.g., top games), which EGMs are the least popular, which EGMs have the most amount of money bet during a period, which EGMs have the highest bet volume, which EGMs are more volatile (e.g., volatility, or deviation from the statistical norms of bet volume, bet amount, pay out, etc.) during a time period, and the like. These searches may also be associated with location queries, time queries, and/or people queries (e.g., where are the electronic gaming machines that allow mission game play options, where are the table games that most of my friends bet on, where are my favorite EGMs, what are players betting on the most today, when are most bets placed, etc.).

The searching structures may be predetermined searching structures. For example, the method may start searching a first device, then a second device, then a third device, up to an $N^{th}$ device based on one or more searching parameters (e.g., triggering event). In one example, the search may end once one or more triggering events are determined. In another example, the search may end once data has been received from a predetermined number (e.g., one, two, ten, one hundred, all) of the devices. In another example, the search may be based on a predetermined number of devices to be searched in combination with a predetermined number of search results to be obtained. In this example, the search structure may be a minimum of ten devices to be searched, along with a minimum of five gaming options to be determined.

In another example, the searching structures may be based on one or more specific games (e.g., a first EGM type, a second EGM type, etc.). Searching structure may search one or more of these games. In one example, a player may utilize a searching function to find one or more games that allow mission functional options and/or to find one or more specific game types (e.g., game theme 1).

A promotional server 236 may include one or more promotional categories, promotional structures, promotional timelines, individual player promotions, and/or any combination thereof. For example, a first promotional category may relate to a type of player, a type of gaming entity, etc. In addition, a first promotional structure may include details relating to a timing and/or a cost of a promotion. Further, a first promotional timeline may include launching a first promotion at a first time, launching a second promotion at a second time, etc. In addition, a first individual promotion may relate to a first client (e.g., bob) where bob has certain characteristics (e.g., likes high variance games with high payouts) which are matched to his individual promotion.

Figure 3:
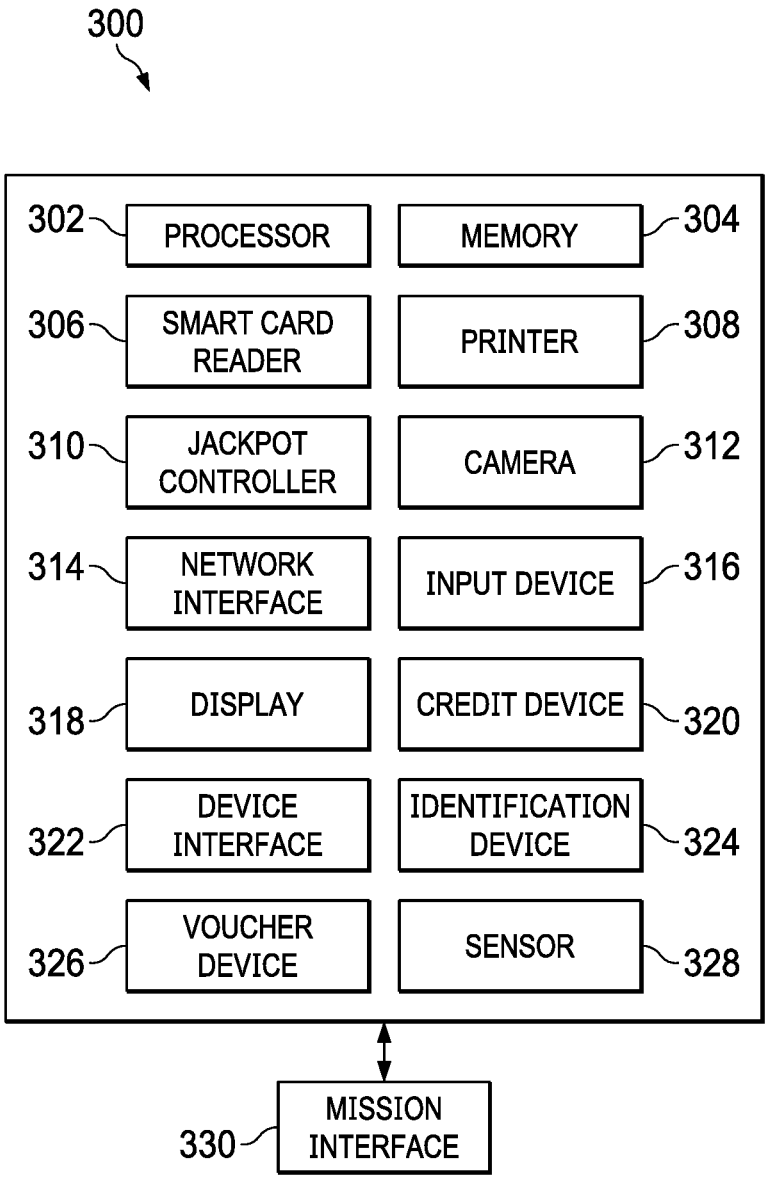
FIG. 3 is a block diagram of the electronic gaming device, according to one embodiment.

FIG. 3 shows a block diagram 300 of electronic gaming device 100. Electronic gaming device 100 may include a processor 302, a memory 304, a smart card reader 306, a printer 308, a jackpot controller 310, a camera 312, a network interface 314, an input device 316, a display 318, a credit device 320, a device interface 322, an identification device 324, a voucher device 326, a sensor 328, and a mission interface 330.

Processor 302 may execute program instructions of memory 304 and use memory 304 for data storage. Processor 302 may also include a numeric co-processor, or a graphics processing unit (or units) for accelerated video encoding and decoding, and/or any combination thereof.

Processor 302 may include communication interfaces for communicating with electronic gaming device 100, electronic gaming system 200, and user interfaces to enable communication with all gaming elements. For example, processor 302 may interface with memory 304 to access a player's mobile device through device interface 322 to display contents onto display 318. Processor 302 may generate a voucher based on a wager confirmation, which may be received by an input device, a server, a mobile device, and/or any combination thereof. A voucher device may generate, print, transmit, or receive a voucher. Memory 304 may include communication interfaces for communicating with electronic gaming device 100, electronic gaming system 200, and user interfaces to enable communication with all gaming elements. For example, the information stored on memory 304 may be printed out onto a voucher by printer 308. Videos or pictures captured by camera 312 may be saved and stored on memory 304. Memory 304 may include a confirmation module, which may authenticate a value of a voucher and/or the validity of the voucher. Processor 302 may determine the value of the voucher based on generated voucher data and data in the confirmation module. Electronic gaming device 100 may include a player preference input device. The player preference input device may modify a game configuration. The modification may be based on data from the identification device.

Memory 304 may be non-volatile semiconductor memory, such as read-only memory ("ROM"), erasable programmable read-only memory ("EPROM"), electrically erasable programmable read-only memory ("EEPROM"), flash memory ("NVRAM"), Nano-RAM (e.g., carbon nanotube random access memory), and/or any combination thereof.

Memory 304 may also be volatile semiconductor memory such as, dynamic random access memory ("DRAM"), static random access memory ("SRAM"), and/or any combination thereof.

Memory 304 may also be a data storage device, such as a hard disk drive, an optical disk drive such as, CD, DVD, Blu-ray, a solid state drive, a memory stick, a CompactFlash card, a USB flash drive, a Multi-media Card, an xD-Picture Card, and/or any combination thereof.

Memory 304 may be used to store read-only program instructions for execution by processor 302, for the read-write storage for global variables and static variables, read-write storage for uninitialized data, read-write storage for dynamically allocated memory, for the read-write storage of the data structure known as "the stack," and/or any combination thereof.

Memory 304 may be used to store the read-only paytable information for which symbol combinations on a given payline that result in a win (e.g., payout) which are established for games of chance, such as slot games and video poker.

Memory 304 may be used to store accounting information (e.g., cashable electronic promotion in, non-cashable electronic promotion out, coin in, coin out, bill in, voucher in, voucher out, electronic funds transfer in, etc.).

Memory 304 may be used to record error conditions on an electronic gaming device 100, such as door open, coin jam, ticket print failure, ticket (e.g., paper) jam, program error, reel tilt, etc., and/or any combination thereof.

Memory 304 may also be used to record the complete history for the most recent game played, plus some number of prior games as may be determined by the regulating authority.

Smart card reader 306 may allow electronic gaming device 100 to access and read information provided by the player or technician, which may be used for setting the player preferences and/or providing maintenance information. For example, smart card reader 306 may provide an interface between a smart card (inserted by the player) and identification device 324 to verify the identity of a player.

Printer 308 may be used for printing slot machine payout receipts, persistent game play data receipts, slot machine wagering vouchers, non-gaming coupons, slot machine coupons (e.g., a wagering instrument with a fixed waging value that can only be used for non-cashable credits), drink tokens, comps, and/or any combination thereof.

Electronic gaming device 100 may include a jackpot controller 310, which may allow electronic gaming device 100 to interface with other electronic gaming devices either directly or through electronic gaming system 200 to accumulate a shared jackpot.

Camera 312 may allow electronic gaming device 100 to take images of a player or a player's surroundings. For example, when a player sits down at the machine his or her picture may be taken to include his or her image into the game play. A picture of a player may be an actual image as taken by camera 312. A picture of a player may be a computerized caricature (i.e., avatar) of the image taken by camera 312. The image obtained by camera 312 may be used in connection with identification device 324 using facial recognition. Camera 312 may allow electronic gaming device 100 to record video. The video may be stored on memory 304 or stored remotely via electronic gaming system 200. Videos obtained by camera 312 may then be used as part of game play, or may be used for security purposes and/or a validating procedure (e.g., persistent gaming receipt validation, etc.). For example, a camera located on electronic gaming device 100 may capture videos of a potential illegal activity (e.g., tampering with the machine, crime in the vicinity, underage players, etc.).

Network interface 314 may allow electronic gaming device 100 to communicate with video/multimedia server 202, gaming server 204, player tracking server 206, voucher server 208, authentication server 210, and/or accounting server 212, and/or any other mission and/or promotional related server (e.g., server to confirm another event (e.g., a horse race, football game, etc.)).

Input device 316 may be mechanical buttons, electronic buttons, a touch screen, and/or any combination thereof. Input device 316 may be utilized to make a wager, to make a mission wager, to modify one of one or more audio devices, one or more display devices, one or more adjustable devices, and/or one or more sensors, to select a movie or music, to select live video streams (e.g., sporting event 1, sporting event 2, sporting event 3), to request services (e.g., drinks, manager, etc.), and/or any combination thereof.

Display 318 may show video streams from one or more content sources. Display 318 may encompass first display screen 102, second display screen 104, third display screen 106, side display screen 108, and/or another screen used for displaying video content.

Credit device 320 may be utilized to collect monies and distribute monies (e.g., cash, vouchers, etc.). Credit device 320 may interface with processor 302 to allow game play to take place. Processor 302 may determine any payouts, display configurations, animation, and/or any other functions associated with game play. Credit device 320 may interface with display 318 to display the amount of available credits for the player to use for wagering purposes. Credit device 320 may interface via device interface 322 with a mobile device to electronically transmit money and/or credits. Credit device 320 may interface with a player's pre-established account, which may be stored on electronic gaming system 200, to electronically transmit money and/or credit. For example, a player may have a credit card or other mag-stripe card on file with the location for which money and/or credits can be directly applied when the player is done. Credit device 320 may interface with a player's card to exchange player points.

Electronic gaming device 100 may include a device interface 322 that a user may employ with his or her mobile device (e.g., smart phone) to receive information from and/or transmit information to electronic gaming device 100 (e.g., watch a movie, listen to music, obtain verbal betting options, verify identification, transmit credits, etc.).

Identification device 324 may be utilized to allow electronic gaming device 100 to determine an identity of a player. Based on information obtained by identification device 324, electronic gaming device 100 may be reconfigured. For example, the language, sound level, music, placement of video streams, placement of images, placement of gaming options, and/or the tables utilized may be modified based on player preference data.

A voucher device 326 may generate, print, transmit, or receive a voucher. The voucher may represent a wagering option, a wagering structure, a wagering timeline, a value of wager, a payout potential, a payout, and/or any other wagering data. A voucher may represent an award, which may be used at other locations inside of the gaming establishment. For example, the voucher may be a coupon for the local buffet or a concert ticket.

Mission interface 330 may be utilized to select a mission, participate in the mission, obtain mission status, and/or complete any other mission functionality.

Figure 4:
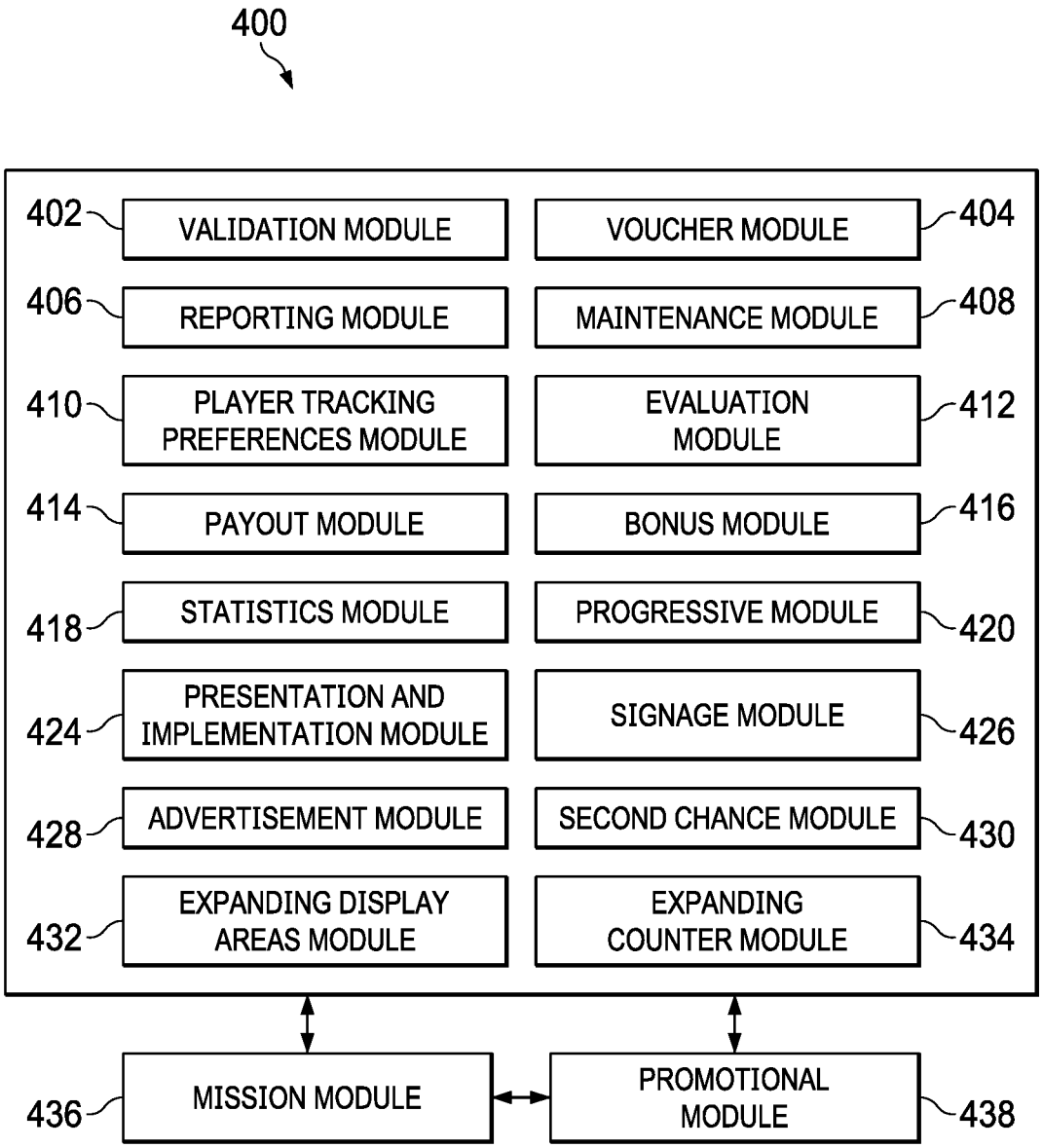
FIG. 4 is another block diagram of the electronic gaming device, according to one embodiment.

FIG. 4 shows a block diagram of memory 304, which includes various modules. Memory 304 may include a validation module 402, a voucher module 404, a reporting module 406, a maintenance module 408, a player tracking preferences module 410, an animation module, a game evaluation module 412, a payout module 414, a sensor module, a scene module, a sensor and scene evaluation module, a sensor and scene output module, a reference models module, an audio module, an audio device adjustment module, a display device adjustment module, a bonus module 416, a statistics module 418, a progressive module 420, a presentation and implementation module 424, a tracking module, a signage module 426, an advertisement module 428, a second chance module 430, a scatter module, a wild module, an expanding display module 432, an expanding counter module 434, a mobile device module, a game configuration module, a mission module 436, and/or a promotional module 438.

Validation module 402 may utilize data received from voucher device 326 to confirm the validity of the voucher and/or a persistent gaming data (e.g., a persistent gaming receipt validation procedure).

Voucher module 404 may store data relating to generated vouchers, redeemed vouchers, bought vouchers, and/or sold vouchers.

Reporting module 406 may generate reports related to a performance of electronic gaming device 100, electronic gaming system 200, video streams, gaming objects, credit device 114, and/or identification device 118.

Maintenance module 408 may track any maintenance that is implemented on electronic gaming device 100 and/or electronic gaming system 200. Maintenance module 408 may schedule preventative maintenance and/or request a service call based on a device error.

Player tracking preferences module 410 may compile and track data associated with a player's preferences.

Animation module may generate, compile, transmit, and/or store one or more animations and/or presentations based on one or more scene data, one or more scenes, one or more reference models, one or more game play data, one or more player profiles, and/or any combination thereof.

Game evaluation module 412 may evaluate one or more outcomes for one or more events relating to game play.

Payout module 414 may determine one or more payouts which may relate to one or more inputs received from the player, electronic gaming device 100, and/or electronic gaming system 200.

Sensor module may generate, compile, transmit, and/or store any data relating to one or more scene data, one or more scene, and/or any other sensor data. This data may include one or more gestures (e.g., body movement made by one or more players).

Scene module may generate, compile, transmit, and/or store on one or more scene data, one or more scenes, one or more reference models, one or more game play data, one or more player profiles, and/or any combination thereof.

Sensor and scene evaluation module may evaluate any data stored on, transmitted to, and/or transmitted from sensor module and scene module. Sensor and scene evaluation module may obtain data including one or more gestures (e.g., body movement made by one or more players) from sensor module and compare this data to one or more body reference models, body part reference models, device reference models, gaming device reference models, floor plan reference models, and/or any other reference models from reference models module to determine one or more actions.

Sensor and scene output module may evaluate the combined output of sensor module and scene module.

Reference models module may generate, compile, transmit, and/or store one or more body reference models, body part reference models, device reference models, gaming device reference models, floor plan reference models, and/or any other reference models which can be utilized by any of the other modules.

Audio module may generate, compile, transmit, and/or store one or more audio structures, sound wave configurations, and/or any other audio data.

Audio device adjustment module may adjust one or more audio devices. These devices may be adjusted physically (e.g., moved) and/or by changing one or more device characteristics.

Display device adjustment module may adjust one or more display devices. These devices may be adjusted physically (e.g., moved) and/or by changing one or more device characteristics.

Bonus module 416 may generate a bonus game, evaluate the results of the bonus game, trigger bonus game presentations, generate bonus game payouts, and/or display any data relating to the bonus game.

Statistics module 418 may be used to maintain data relating to historical game play (including stacking wagering data—(dollar amount, credit amount, spins, credits per line bet, time period, maximum win amount, one or more triggering events to stop game play, etc.)) for one or more electronic gaming devices 100.

Progressive module 420 may generate, transmit, compile, and/or store one or more data points relating to one or more progressives.

Presentation and implementation module 424 may generate, transmit, compile, implement, and/or store one or more presentations.

Tracking module may generate, transmit, compile, and/or store one or more data points related to tracking one or more stacking wagers and/or stacking wager players.

Signage module 426 may generate, transmit, compile, initiate, and/or store one or more presentations for one or more signs.

Advertisement module 428 may generate, transmit, compile, present, implement, initiate, and/or store one or more advertisements. Advertisement module 428 may generate, compile, transmit, and/or store advertisement information relating to one or more missions, and/or any other gaming feature. These advertisements may be presented on one or more display screens, an internet website, and/or any other advertisement avenue.

Searching module may implement a search on one or more gaming devices to obtain gaming data. Searching module may implement a messaging function, which may transmit a message to a third party (e.g., a player) relating to a search, a search status update, a game status update, a wager status update, a confirmation of a wager, a confirmation of a money transfer, and/or any other data relating to the player's account. The message can take the form of a text display on the gaming device, a pop up window, a text message, an email, a voice message, a video message and the like. Searching module may implement a wagering function, which may be an automatic wagering mechanism. These functions of searching module may be integrated into one or more servers.

In one example, the searching structures may be based on one or more specific games (e.g., a first EGM type, a second EGM type, etc.). Searching structure may search one or more of these games.

In another example, the searching structure may be based on a player's preferences, past transactional history, player input, a particular EGM, a particular casino, a particular location within a casino, game outcomes over a time period, payout over a time period, and/or any other criteria.

Wild module may generate a wild game, evaluate the results of the wild game, trigger wild game presentations, generate wild game payouts, and/or display any data relating to the wild game. Further, wild module may determine one or more outcomes of one or more interactions (e.g., collisions of one or more symbols).

Scatter module may generate a scatter game, evaluate the results of the scatter game, trigger scatter game presentations, generate scatter game payouts, and/or display any data relating to the scatter game.

Skill-based module may generate, compile, store, and/or transmit one or more skill-based structures and/or one or more skill-based tournament structures. Skill-based evaluation module may evaluation one or more outcomes of one or more skill-based games and/or skill-based tournament games.

Mobile device module may generate, compile, store, and/or transmit one or more data relating to the mobile device. Further, mobile device module may interact and communicate with mobile device to transfer and/or receive data from and/or to mobile device.

Game configuration module may generate, compile, store, and/or transmit one or more game configuration data. Further, mobile device may also include a game configuration module.

Mission module 436 may generate, compile, store, and/or transmit one or more mission game configuration data. Further, mission module 436 may be utilized to implement one or more missions.

Promotional module 438 may generate, compile, store, and/or transmit one or more promotional data. Further, promotional module 438 may be utilized to implement one or more promotions.

Figure 5:
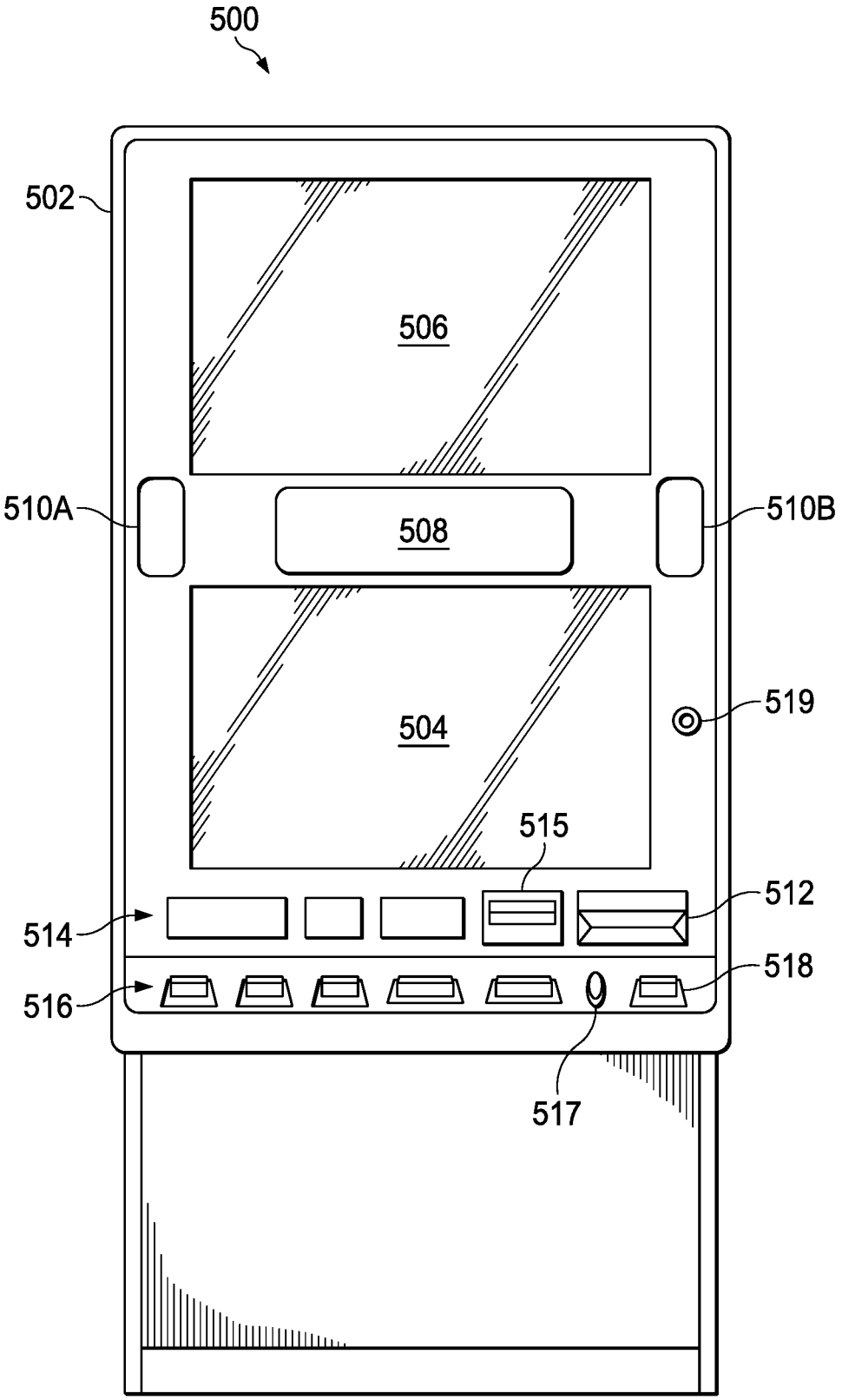
FIG. 5 is an illustration of game play on a gaming device, according to one embodiment.

In FIG. 5, an illustration of a gaming device cabinet 500 is shown, according to one embodiment. A gaming device 502 may include an overhead display 506, a side display 508, a main game display 504, a left speaker 510A, a right speaker 510B, one or more output devices (e.g., a ticket in/ticket out device 512), and/or one or more input devices 516 (e.g., buttons, bill validators, etc.). In one example, overhead display 506 includes a leadership board sponsor and/or a ranking of tournament players. In this example, the XYZ company has sponsored the leadership board and the leadership board states "XYZ LEADER BOARD." In another example, leadership display may include data relating to one or more tournaments, such as, the time remaining (e.g., 1 HOUR 25 MINUTES REMAINING). In this example, side display 508 may display a current mode of operation. For example, a current mode may be a tournament mode, a normal mode, a practice mode, a team mode, an individual mode, any combination thereof, etc. It should be noted that game play may be implemented on a virtual gaming device which may be configured utilizing one or more elements shown in gaming device cabinet 500 but would be digital instead of physical.

Figure 6A:
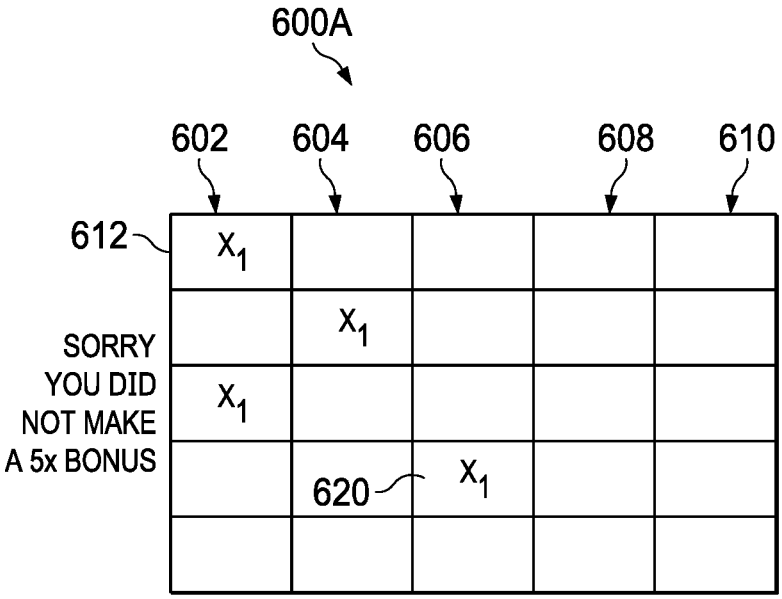
FIG. 6A is another illustration of mission game play on a gaming device, according to one embodiment.

In FIG. 6A, another illustration of mission game play on a gaming device is shown, according to one embodiment. In this example, a first mission requires that the player obtain a 5× bonus during game play. To achieve this 5× bonus during game play, the game must result in 5 bonus symbols 620 being displayed in the game area at the end of the game play. In this example, the player has not achieved a 5× bonus during game play because there are only 4 bonus symbols 620 shown. Therefore, the first mission failed.

Figure 6B:
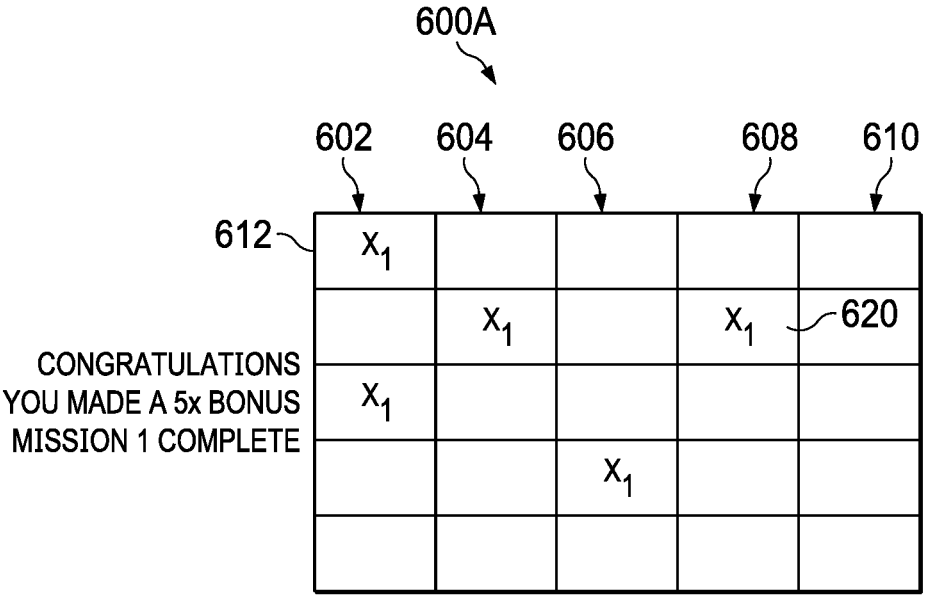
FIG. 6B is another illustration of mission game play on a gaming device, according to one embodiment.

In FIG. 6B, another illustration of mission game play on a gaming device is shown, according to one embodiment. In this example, a first mission requires that the player obtain a 5× bonus during game play. To achieve this 5× bonus during game play, the game must result in 5 bonus symbols 620 being displayed in the game area at the end of the game play. In this example, the player has achieved a 5× bonus during game play because there are 5 bonus symbols 620 shown. Therefore, the first mission succeeded.

Figure 6C:
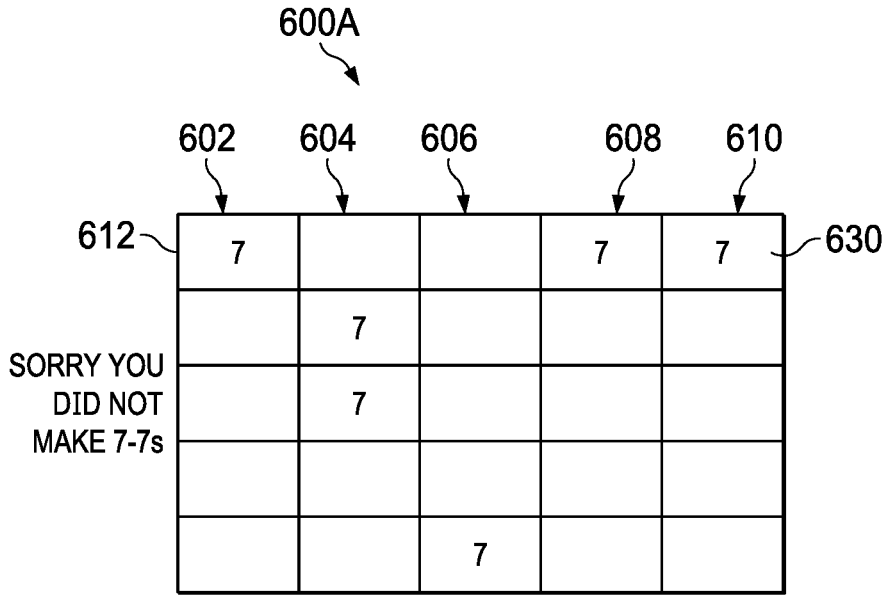
FIG. 6C is another illustration of mission game play on a gaming device, according to one embodiment.

In FIG. 6C, another illustration of mission game play on a gaming device is shown, according to one embodiment. In this example, a second mission requires that the player obtain seven 7s during game play. To complete this mission during game play, the game must result in 7 seven bonus symbols 630 being displayed in the game area at the end of the game play. In this example, the player has not achieved seven 7s during game play because only 6 seven bonus symbols 630 are shown at the end of game play. Therefore, the second mission failed.

Figure 6D:
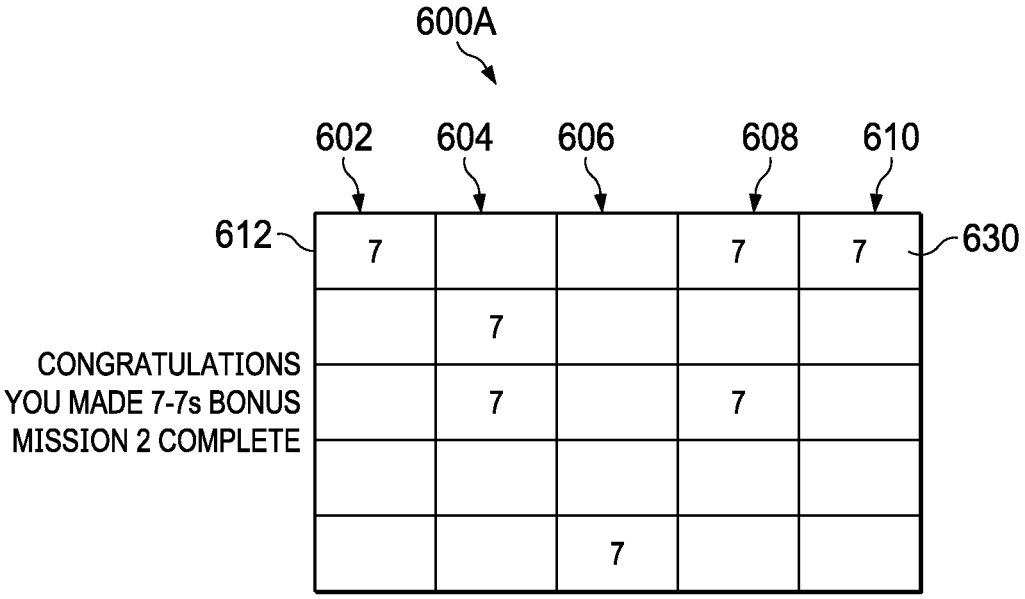
FIG. 6D is another illustration of mission game play on a gaming device, according to one embodiment.

In FIG. 6D, another illustration of mission game play on a gaming device is shown, according to one embodiment. In this example, a second mission requires that the player obtain seven 7s during game play. To complete this mission during game play, the game must result in 7 seven bonus symbols 630 being displayed in the game area at the end of the game play. In this example, the player has achieved seven 7s during game play because 7 seven bonus symbols 630 are shown at the end of game play. Therefore, the second mission has succeeded. In one example, the second mission cannot be initiated until the first mission is completed. In another example, the second mission can be initiated before the first mission is completed.

Figure 7:
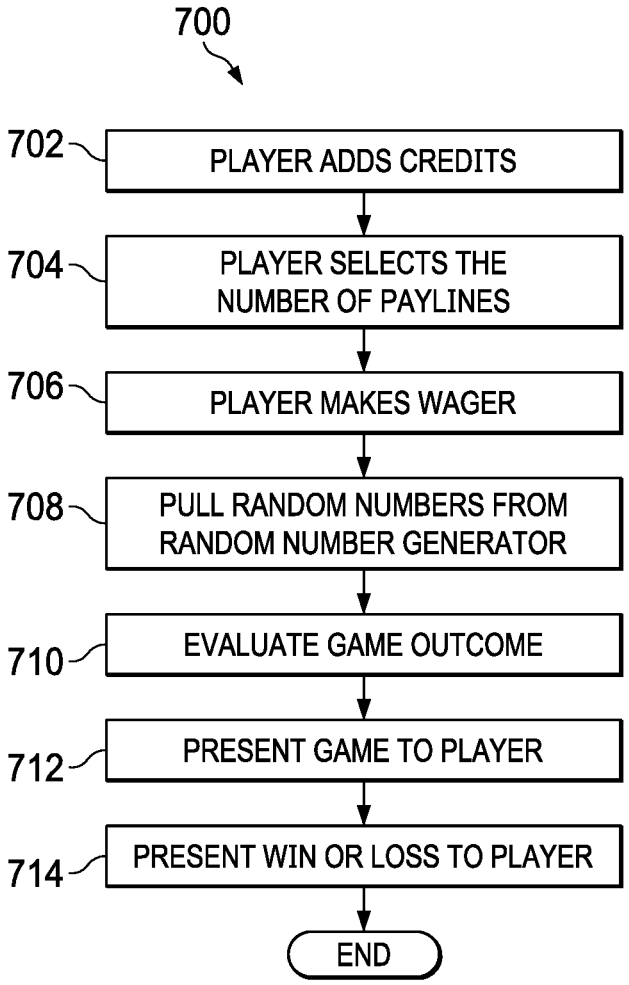
FIG. 7 is a flow diagram for game play, according to one embodiment.

In FIG. 7, a process flowchart of one example of a primary game play 2600 on an electronic gaming system is shown, according to one embodiment. The method may include the step of a player adding credit to the electronic gaming system (step 702). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 704, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 706, the player makes a wager on the game. In one embodiment, the wager may be a multiple of the number of paylines selected at step 704. In another embodiment, the wager may not be a multiple of the number of paylines selected at step 704. In a further embodiment, the wager may include a side-wager (e.g., ante bet), which may, in one example of such an embodiment, be used to make the player eligible to be awarded the extra functionality discussed above. It should be appreciated that in some embodiments, the order of steps 704 and 706 may not be critical, and so for example, a player can select the wager they wish to place, and then select the number of paylines they want it applied to, and that these embodiments are expressly contemplated as being within the scope of the present disclosure.

Continuing to step 708, the gaming system pulls random numbers from a random number generator ("RNG"). In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At steps 710 and 712, the gaming system utilizes the random numbers pulled at step 708 to determine the primary game symbols to display in the play of the primary game, which in turn both determines the presentation of the game to the player and evaluates the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 714, the win or loss outcome may be identified for the player. In one embodiment, this step can include additional messaging, which provides information related to the win or lose, such as why the player won or lost. In another embodiment, this step can include identification of the amount of any award earned by the player.

Figure 8:
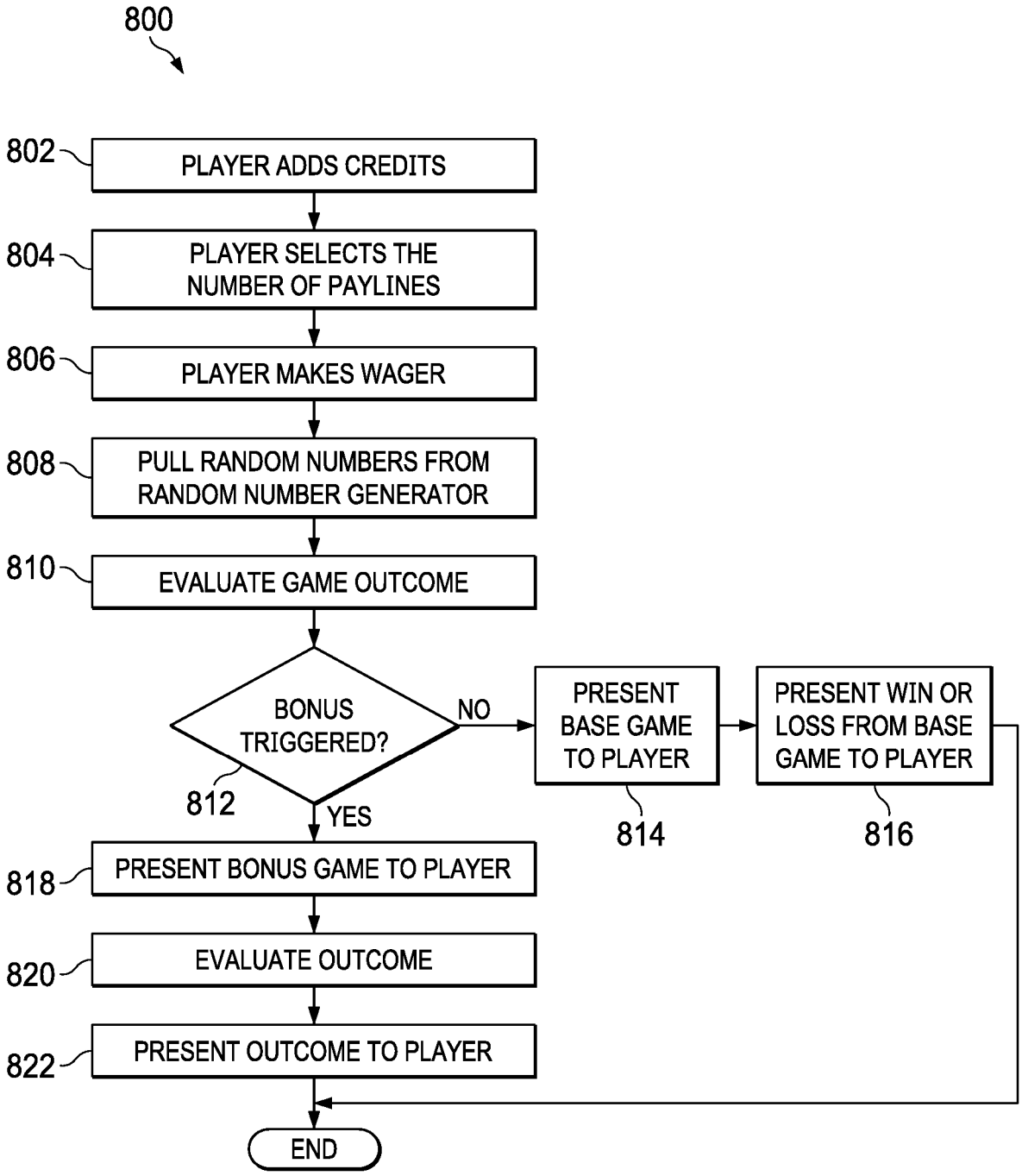
FIG. 8 is a flow diagram for game play, according to one embodiment.

FIG. 8 is a process flowchart of one example of a combined primary and secondary game play 800 on an electronic gaming system, according to one embodiment.

The method may include the step of a player adding credit to the electronic gaming system (step 802). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 804, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 806, the player makes a wager on the game. In one embodiment, the wager may be a multiple of the number of paylines selected at step 804. In another embodiment, the wager may not be a multiple of the number of paylines selected at step 804. In a further embodiment, the wager may include a side-wager, which may, in one example of such an embodiment, be used to make the player eligible to be awarded the extra functionality discussed above. It should be appreciated that in some embodiments, the order of steps 804 and 806 may not be critical, and so for example, a player can select the wager they wish to place, and then select the number of paylines they want it applied to, and that these embodiments may be expressly contemplated as being within the scope of the present disclosure.

Continuing to step 808, the gaming system pulls random numbers from a random number generator "RNG". In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At step 810, the gaming system utilizes the random numbers pulled at step 808 to evaluate the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 812, the gaming system determines if a secondary or bonus game may be triggered. In one embodiment, the bonus game is triggered by the display of a plurality of matching symbols at a plurality of predetermined symbol positions within a play of the primary game. In one example, the bonus game may be triggered if a plurality of matching symbols is displayed on the 2nd, 3rd and 4th reel. In another example, the bonus game may be triggered if matching symbols are displayed on the 1st, 2nd and 3rd reels. In a further example, the bonus game may be triggered if matching symbols occur at predetermined symbol positions that include consecutive and non-consecutive reels. In another example, a bonus game (e.g., secondary game) may be triggered in any way (e.g., one special symbols in any locations, one special symbol in one or more predetermined locations, two special symbols in any locations, two special symbols in one or more predetermined locations, three special symbols in any locations, three special symbols in one or more predetermined locations, etc.).

If it is determined that a bonus or secondary game was not triggered, the process continues to step 814, where the base game may be fully presented to the player. As discussed above, the orders of step 810, 812, and 814 can be changed without affecting the novel concepts disclosed herein.

At step 816, the win or loss outcome of the primary game may be identified for the player. In one embodiment, this step can include additional messaging, which provides information related to the win or lose, such as why the player won or lost. In another embodiment, this step can include identification of the amount of any award earned by the player If it is determined at step 812 that a bonus or secondary game was triggered, then process 800 continues to step 818, where the secondary game may be presented to the player. As discussed above, there are numerous ways to present the secondary or bonus game to the player.

At steps 820 and 822, the outcome of the secondary game may be evaluated and presented to the player. In one embodiment, the outcome of the bonus game will always be a winning outcome. In another embodiment, the outcome of the secondary game will cause a significant award to be provided to the player. In one example of such an embodiment, the award may not be provided by the gaming system, as a casino operator may need to verify tax information before allowing such an award to be provided to the player. In one embodiment, instead of the process 800 ending after step 822, the process continues to step 814 so as to finalize the primary game outcome presentation to the player.

Figure 9:
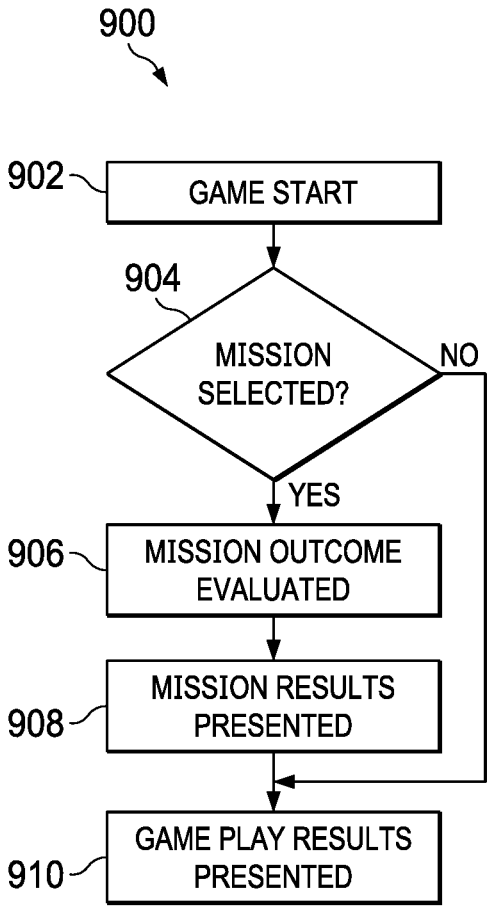
FIG. 9 is a flow diagram for game play, according to one embodiment.

FIG. 9 is a process flowchart of one example of a mission game play, according to one embodiment. A method 900 may include the steps of starting a game play (step 902). Further, the method 900 may include one or more processors determining whether a mission was selected (step 904). If a mission was not selected, then the method 900 may include presenting the game play results (step 910). If a mission was selected, then the method 900 may include evaluating a mission outcome (step 906). The method 900 may then include presenting the mission results (step 908) and then going to step 910. In one example, a first mission is selected where the player must obtain a bonus of 10×. In one example, the game results show that the player did not achieve the 10× bonus, therefore the first mission failed. In another example, the player does achieve the 10× bonus; therefore the first mission is a success.

Figure 10:
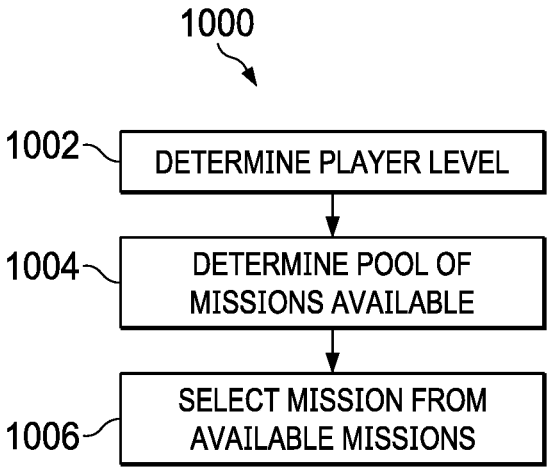
FIG. 10 is a flow diagram for game play, according to one embodiment.

FIG. 10 is a process flowchart of one example of mission selection, according to one embodiment. A method 1000 may include determining a player's level (step 1002). The method 1000 may include determining a pool of mission available based one the determined player's level (step 1004). Further, the method 1000 may include selecting one or more mission from the available mission pool (step 1006). In one example, the player is at a $2^{nd}$ level, therefore, levels 1-10 are available for play. Please note that there may be N level (e.g., 1-100, 1-1000, etc.).

In another example, a first player is at a $1^{st}$ level, therefore, only missions 1 through 20 are available. In this example, a second player is at a $2^{nd}$ level, therefore, only missions 21 to 50 are available. In another example, the second player at a $2^{nd}$ level may have missions 1-50 available for game play (in other words, the second player at the $2^{nd}$ level may play missions from the $1^{st}$ level. In this example, a third player at a $3^{1d}$ level may have missions 1-100 available for game play. In another example, the third player at a $3^{rd}$ level may be able to play missions 21-100 and/or 1-100. In this example, an Nth player may be at an Nth level and have missions all the missions available and/or any subset of missions.

Figure 11:
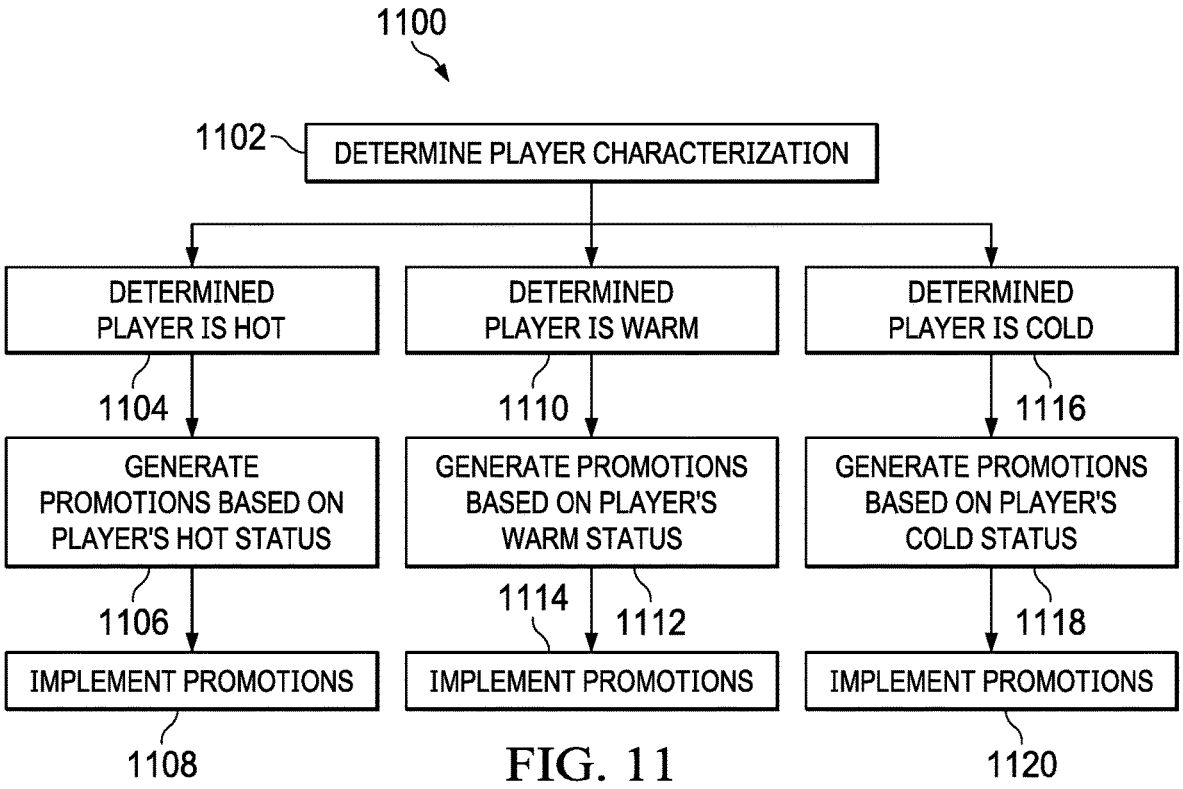
FIG. 11 is a flow diagram for game play, according to one embodiment.

FIG. 11 is a process flowchart for implementing one or more promotions, according to one embodiment. A method 1100 may include one or more processors determining a player characterization (step 1102). The method 1100 may include the one or more processors determining that a player is in a first category (e.g., Hot) (step 1104). When the player is in the first category, then the method 1100 may generate promotions based on the player's first category status (step 1106). The method 1100 may then implement these generated promotions (step 1108). Alternatively, the method 1100 may include the one or more processors determining that a player is in a second category (e.g., Warm) (step 1110). When the player is in the second category, then the method 1100 may generate promotions based on the player's second category status (step 1112). The method 1100 may then implement these generated promotions (step 1114). In another alternative, the method 1100 may include the one or more processors determining that a player is in a third category (e.g., Cold) (step 1116). When the player is in the third category, then the method 1100 may generate promotions based on the player's third category status (step 1118). The method 1100 may then implement these generated promotions (step 1120). In various examples, these promotions may be implemented in series, in parallel, and/or in any order. In one example, a first player with a first status (e.g., hot) is given a first promotion which increases the likelihood that the first player will continue playing and/or increasing their bet size. In another example, a second player with a second status (e.g., warm) is given a second promotion which has one or more favorable characteristics for the gaming site.

Figure 12A:
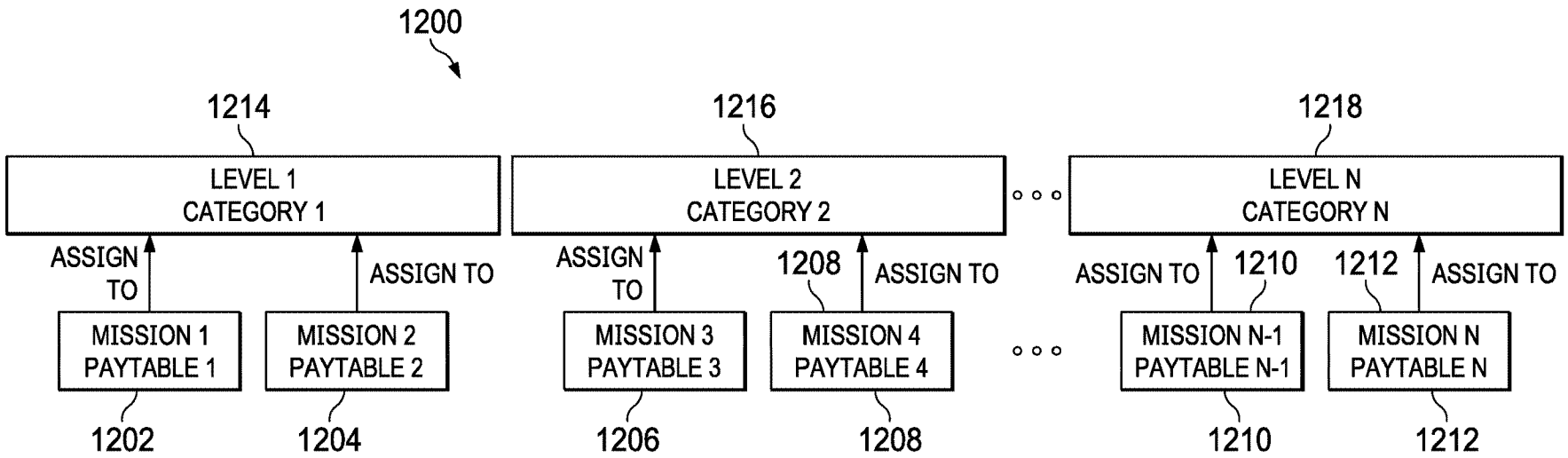
FIG. 12A is an illustration of categories of missions, according to one embodiment.

In FIG. 12A, a mission categorization structure is shown, according to one embodiment. In one example, there may be numerous missions which may include a first mission 1202, a second mission 1204, a third mission 1206, a fourth mission 1208, an N-1 mission 1210, and/or an N mission 1212. Where the first mission 1202 utilizes a first paytable, the second mission 1204 utilizes a second paytable, the third mission 1206 utilizes a third paytable, the fourth mission 1208 utilizes a fourth paytable, then N-1 mission 1210 utilizes an N-1 paytable, and/or the N mission 1212 utilizes an N paytable. In other examples, one or more missions may utilize the same paytable. In another example, a few missions utilize the same paytable. In another example, no missions utilize the same paytable. In another example, all missions except for one utilize the same paytables, etc.

In the example shown in FIG. 12A, the first mission 1202 and the second mission 1204 are assigned to a first category 1214. Further, a third mission 1206 and a fourth mission 1208 are assigned to a second category 1216. In addition, the N-1 mission 1210 and the N mission 1212 are assigned to an N category 1218.

Figure 12B:
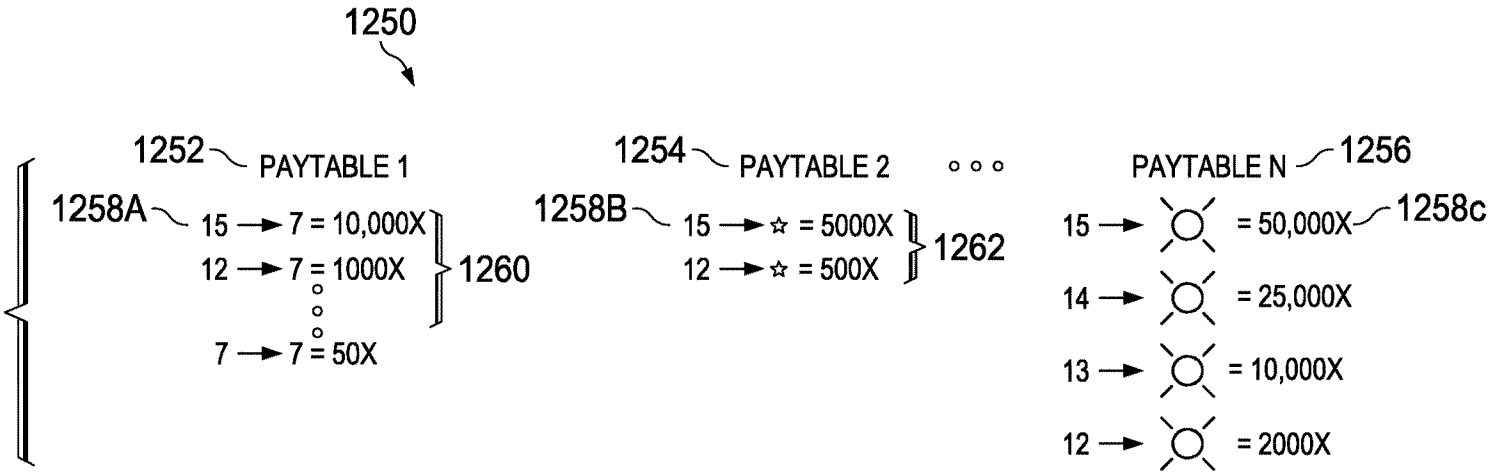
FIG. 12B is an illustration of various paytables, according to various embodiments.

FIG. 12B is an illustration of various paytables, according to one or more embodiments. A first paytable 1252 may include a first number of payout lines 1260. Further, a second paytable 1254 may include a second number of payout lines 1262. While an Nth paytable 1256 may include an Nth number of payout lines. In this example, a first paytable top prize relates to obtaining 15 7s which pays out 10,000 to 1. Whereas, a second paytable top prize relates to obtaining 15 stars which pays out 5,000 to 1. Further, an Nth paytable top prize relates to obtaining 15 suns which pays out 50,000 to 1.

Figure 13A:
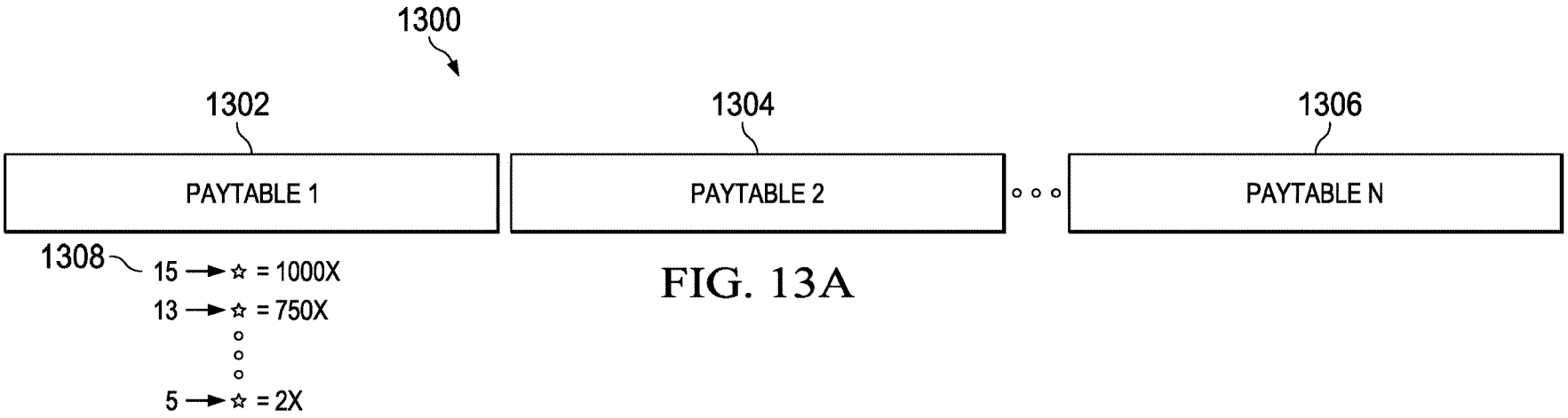
FIG. 13A is an illustration of various paytables, according to various embodiments.
Figure 13B:
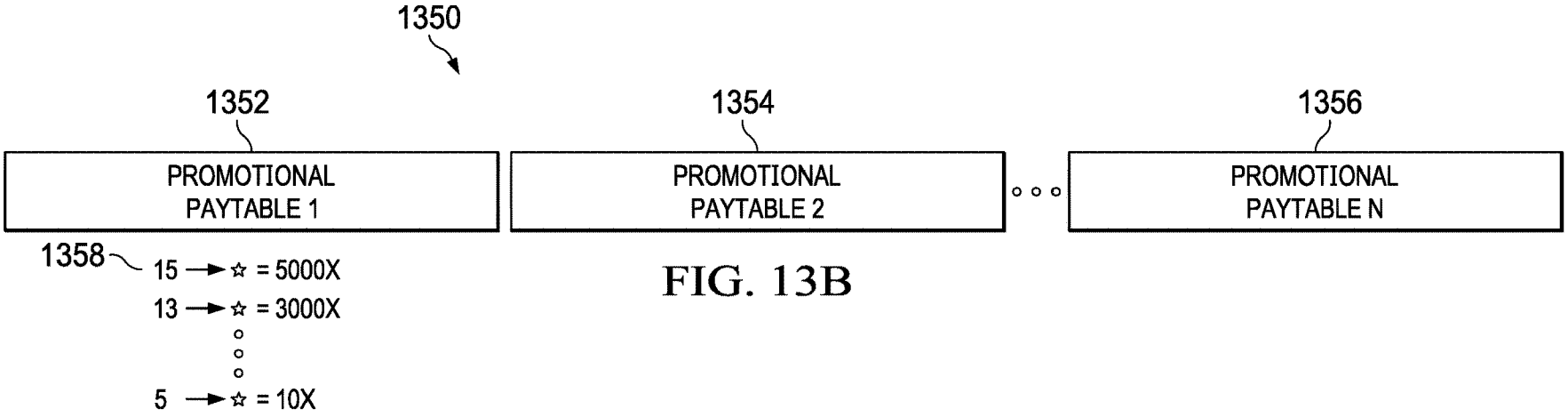
FIG. 13B is an illustration of various promotional paytables, according to various embodiments.

FIG. 13A is an illustration of various paytables, according to one embodiment. In this example, there is a first paytable 1302, a second paytable 1304, and an Nth paytable 1306. The first paytable 1302 has various prize amounts including a top prize of 1000 to 1 for achieving 15 stars. These paytables may be utilized for normal game play (e.g., no promotions).

FIG. 13A is an illustration of various promotional paytables, according to one embodiment. In this example, there is a first promotional paytable 1352, a second promotional paytable 1354, and an Nth promotional paytable 1356. The first promotional paytable 1352 has various prize amounts including a top prize of 5000 to 1 for achieving 15 stars. Therefore, one or more prizes on the paytable are increased when a promotional paytable is utilized.

Figure 14:
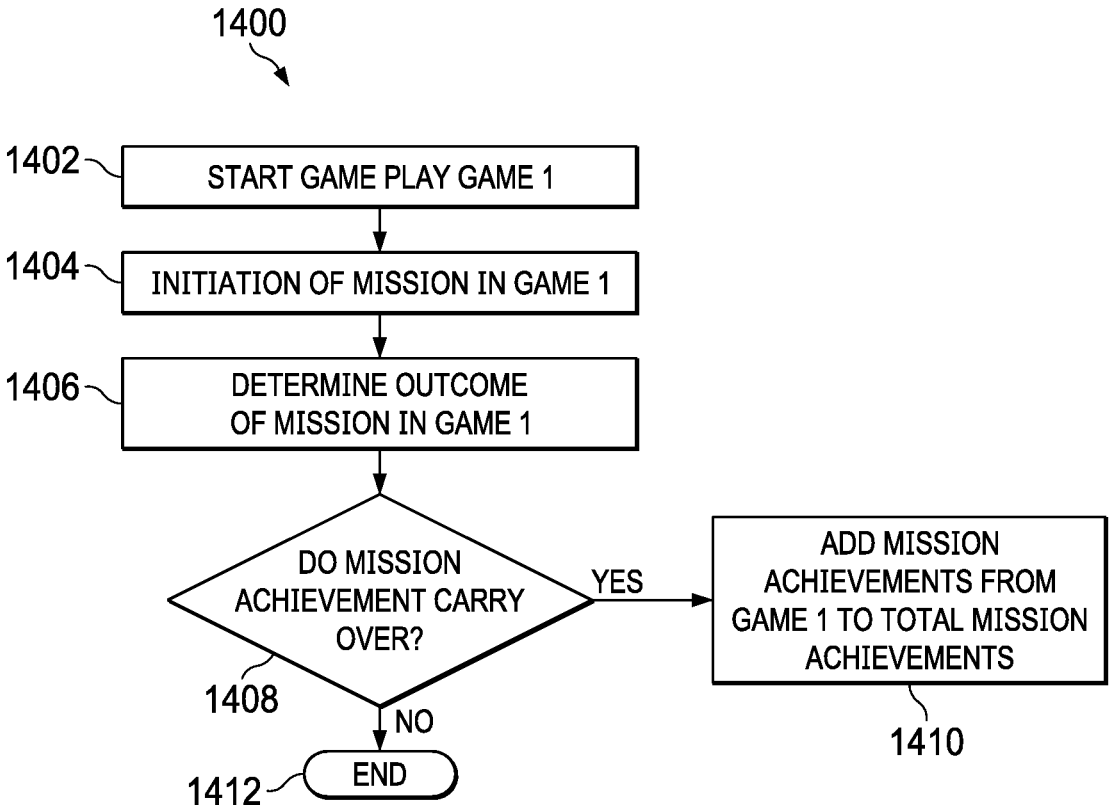
FIG. 14 is a flow diagram for game play, according to one embodiment.

FIG. 14 is a process flow chart of game play with mission functionality, according to one embodiment. A method 1400 may include the start of a first game play (step 1402). The method 1400 may include initiating a first mission in a first game (step 1404). The method 1400 may include determining an outcome of the first mission in a first game play (step 1406). The method may include determining via one or more processors whether a first mission achievement is to be carried over (step 1408). If the first mission achievement is not to be carried over, then the method 1400 ends (step 1412). If the first mission achievement is to be carried over to another game and/or multiple games, then the method 1400 may include adding the first mission achievement from the first game to a total mission achievements database and/or information (step 1410). In a first example, the achievements do not carry over. Therefore, the player starts at zero on every new spin. Whereas in a second example, the achievements do carry over. Therefore, after a first game play the player may have 2 achievements but after winning another achievement in a third game play, the player may have 3 achievements.

Figure 15:
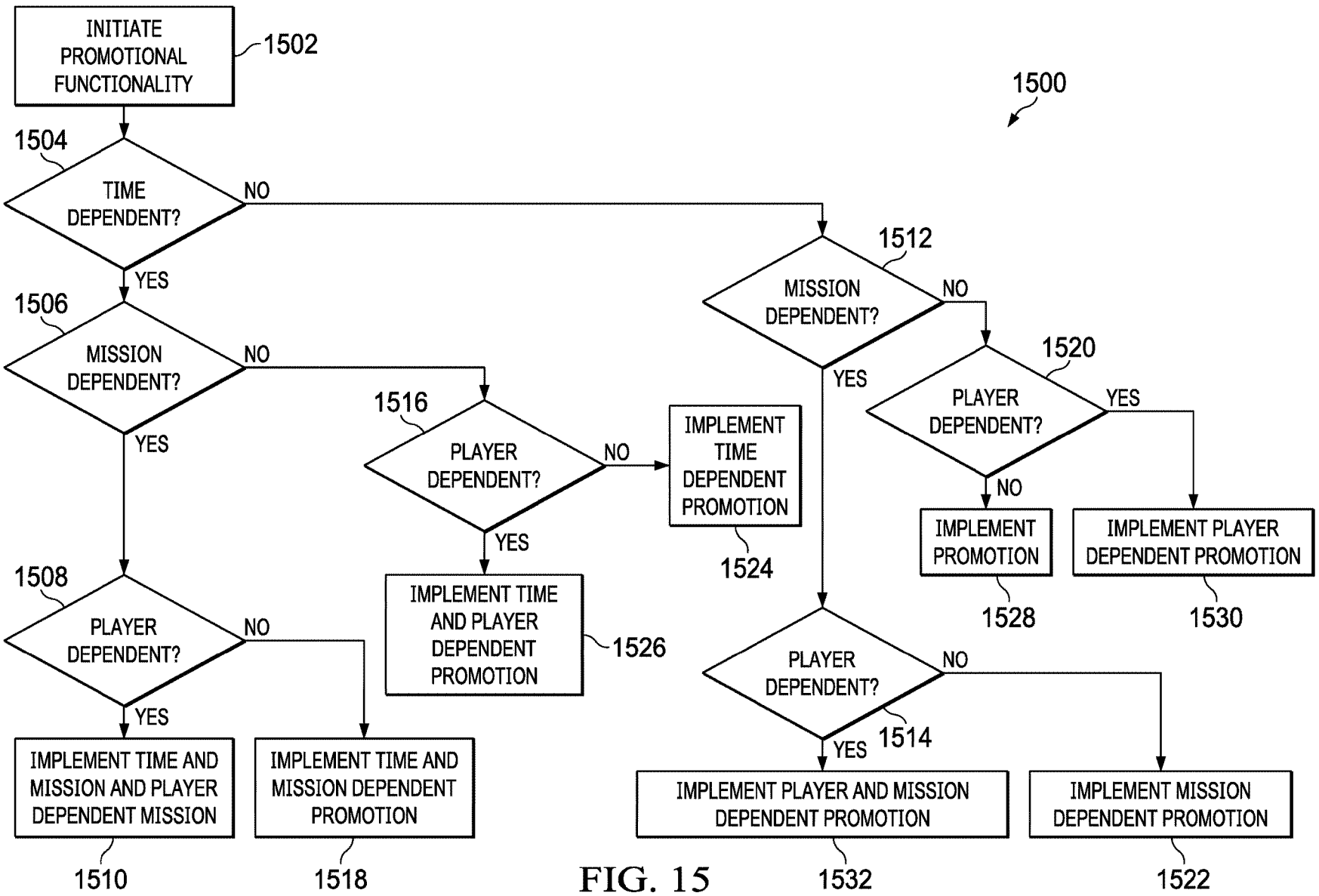
FIG. 15 is a flow diagram for game play, according to one embodiment.

In FIG. 15, a flowchart of various promotional implementations is shown, according to one or more embodiments. A method 1500 may include initiating one or more promotional functionalities (step 1502). The method 1500 may include one or more processors determining whether the promotion is time dependent (step 1502). If the promotion is not time dependent, then the one or more processors may determine whether the promotion is mission dependent (step 1512). If the promotion is not mission dependent, then the one or more processors may determine whether the promotion is player dependent (step 1520). If the promotion is not player dependent, then the one or more processors implements the promotion which is not dependent on time, the mission, and/or the player (step 1528). If the promotion is player dependent, then the one or more processors implements the promotion which is player dependent (step 1530). Returning to step 1512, the one or more processors may determine that the promotion is mission dependent, then the method 1500 may include the one or more processors determining whether the promotion is player dependent (step 1514). If the promotion is not player dependent, then the method 1500 may implement via one or more processors a mission dependent promotion (step 1522). If the one or more processors determine that the promotion is player dependent, then the method 1500 may implement via the one or more processors a player and mission dependent promotion (step 1532). Returning to step 1504, the one or more processors may determine that the promotion is time dependent, then the method 1500 may include one or more processors determining whether the promotion is mission dependent (step 1506). If the promotion is not mission dependent, then the method may include the one or more processors determining whether the promotion is player dependent (step 1516). If the promotion is not player dependent, then the one or more processors may implement a time dependent promotion (step 1524). If the promotion is player dependent, then the one or more processors may implement a time and player dependent promotion (step 1526). Returning to step 1506, if the one or more processors determine that the promotion is mission dependent, then the method 1500 may determine via the one or more processors whether the promotion is player dependent (step 1508). If the promotion is not player dependent, then the one or more processors may implement a time and mission dependent promotion (step 1518). If the promotion is player dependent, then the one or more processors may implement a time, mission, and player dependent promotion (step 1510). It should be noted that any number of variables may be utilized on which the promotion may be dependent (e.g., time of year, season, location, etc.). In one example, a promotion may be time dependent. Therefore, the promotion may run on Sunday from 2 pm to 5 pm. In another example, the promotion may be mission dependent. Therefore, only missions 1-5 would be part of the promotion. In one example, only players eligible to play missions 1-5 would be eligible to take part in the promotion. In another example, the promotion may be player dependent. In one example, only players at a specific rating level could take part in the promotion. In another example, only players that have been members and/or had a certain length of time and/or game plays would be eligible to take part in the promotion.

Figure 16A:
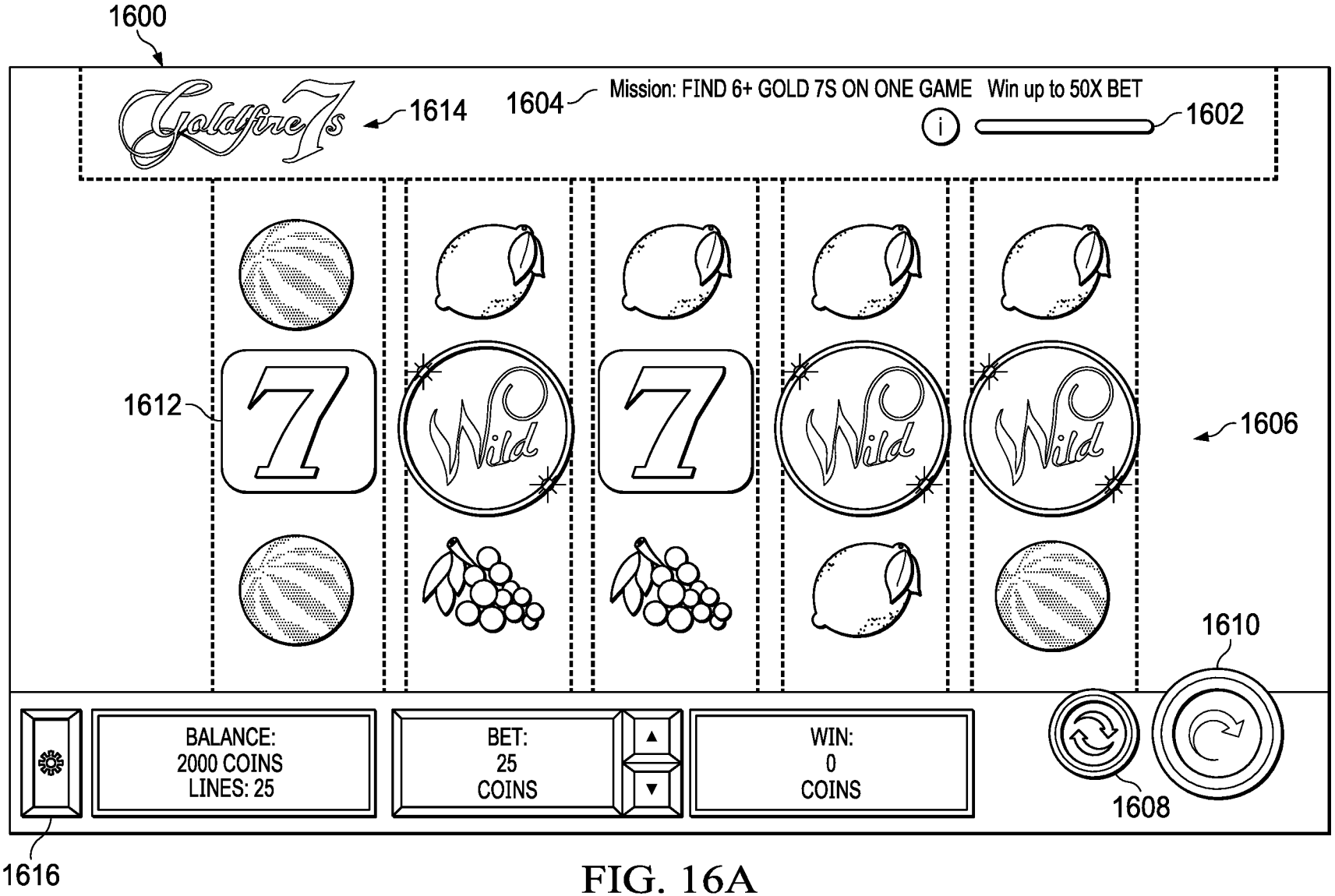
FIG. 16A is an illustration of game play, according to one embodiment.

In FIG. 16A, an illustration of game play is shown, according to one embodiment. A first gaming illustration 1600 includes a mission meter 1602, a mission objective area 1604, a game play area 1606, a replay button 1608, a new game play button 1610, and a game information button 1616. In a first example, the game play area 1606 includes numerous gaming symbols including a non-gold-fire seven symbol 1612. In this first example, the game play has resulted in zero gold-fire seven symbols. Therefore, the mission meter 1602 has a zero reading. Further, the replay button 1608 may be utilized to review the last game play illustrations (e.g., spin) and/or any other previous game play illustrations. The mission objective area 1604 may include one or more criteria relating to the mission. In this example, the mission objective area 1604 includes the statement that find 6+ gold 7S on one game to win up to 50 times your bet. In this example, the gold 7S are the same as the gold fire seven symbols.

Figure 16B:
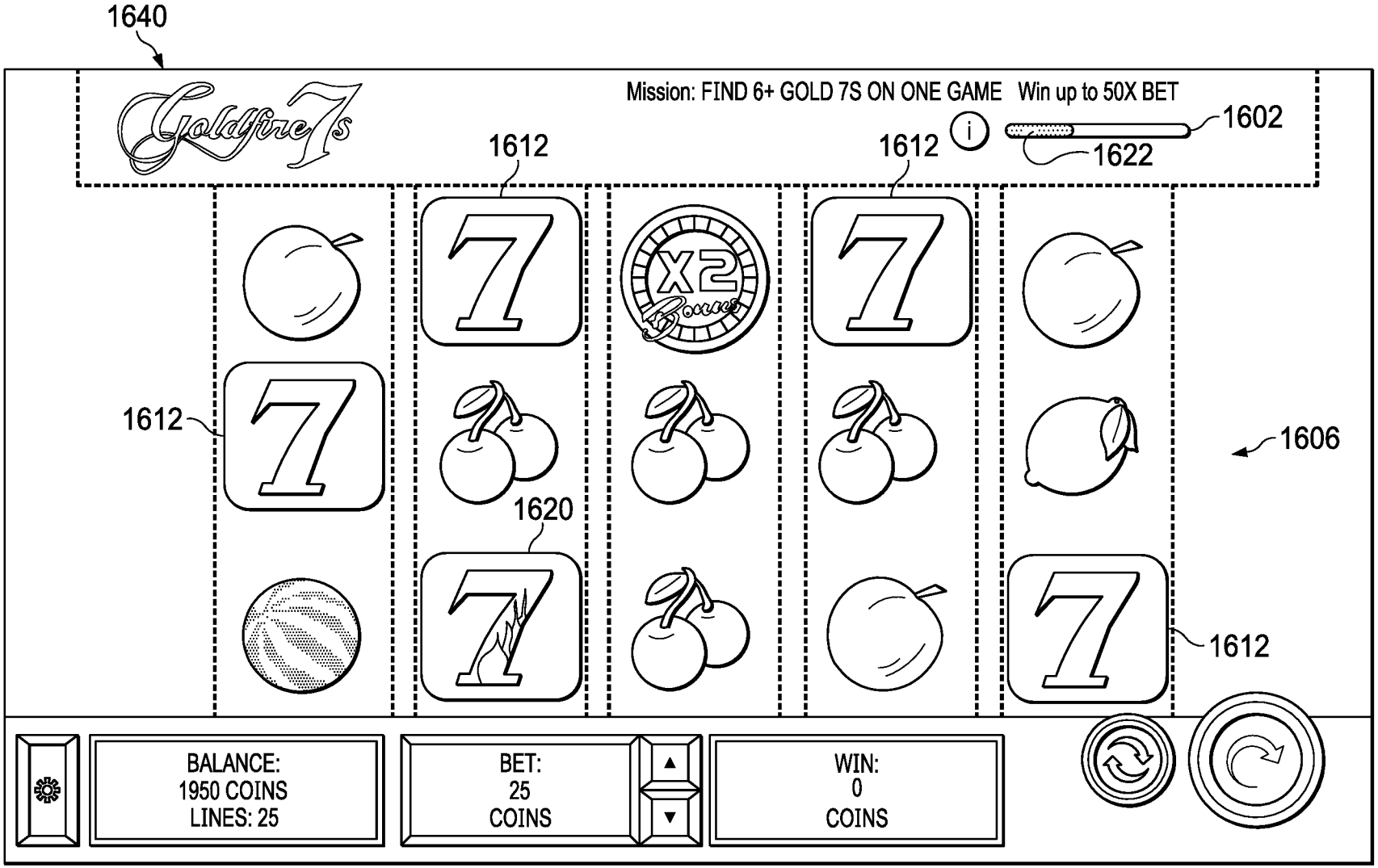
FIG. 16B is another illustration of game play, according to one embodiment.

In FIG. 16B, another illustration of game play is shown, according to one embodiment. A second gaming illustration 1640 shows that the game play has resulted in a gold-fire seven symbol 1620 being displayed on the game play area 1606. Therefore, the mission meter 1602 has moved up to a first level 1622. However, only one gold-fire seven symbol 1620 was generated and not the 6+ needed to complete the mission. Therefore, the mission has not been completed. In this example, the four non-gold-fire seven symbols 1612 cannot be utilized to complete the mission.

Figure 16C:
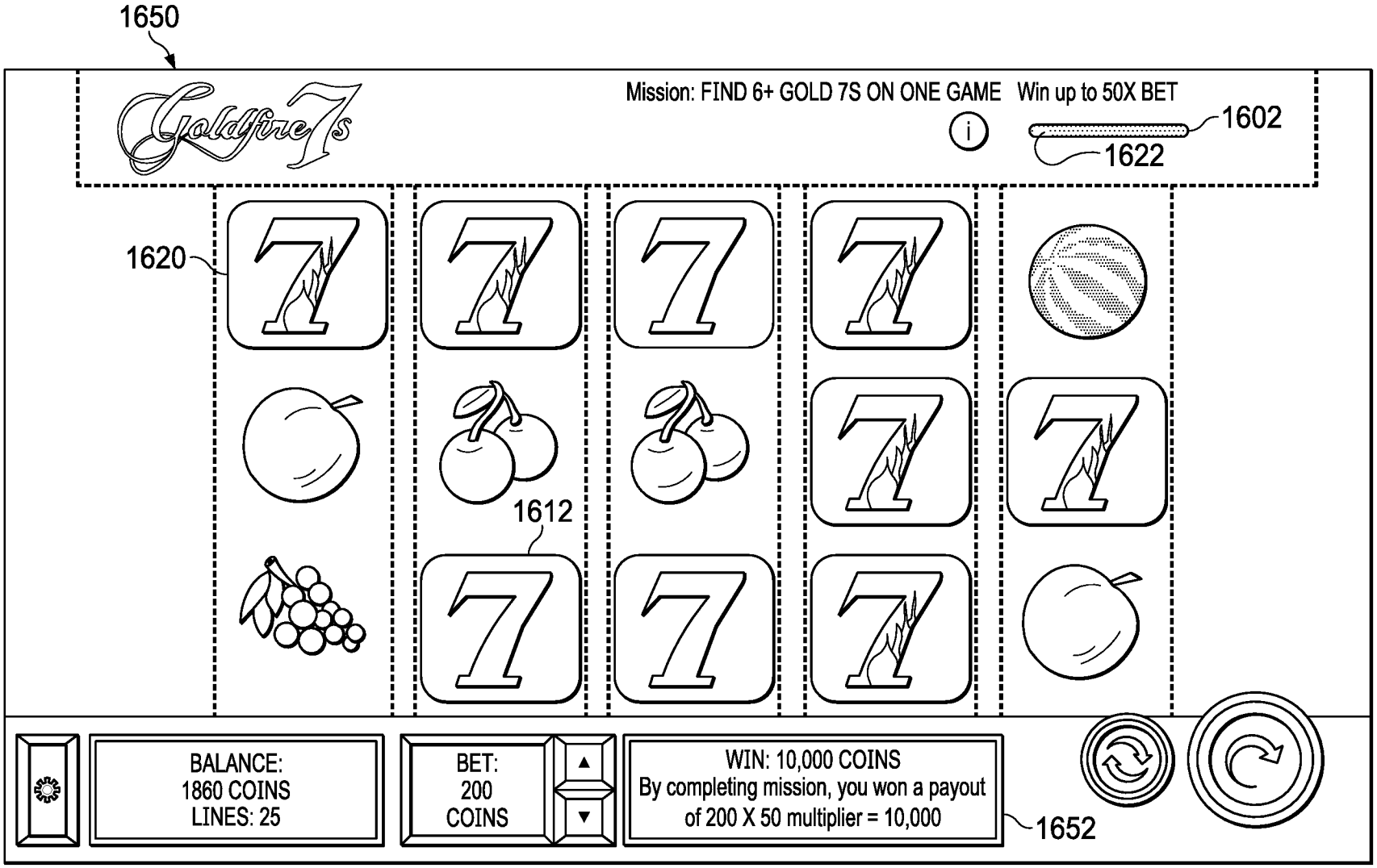
FIG. 16C is another illustration of game play, according to one embodiment.

In FIG. 16C, another illustration of game play is shown, according to one embodiment. A third gaming illustration 1650 shows that the game play has resulted in numerous gold-fire seven symbols 1620 being displayed on the game play area 1606. Therefore, the mission meter 1602 has moved up to a completed level—therefore, the mission has been completed. A completed mission message 1652 may state "by completing the mission, you won a payout of 200 times 50 multiplier which equals 10,000 credits."

Figure 16D:
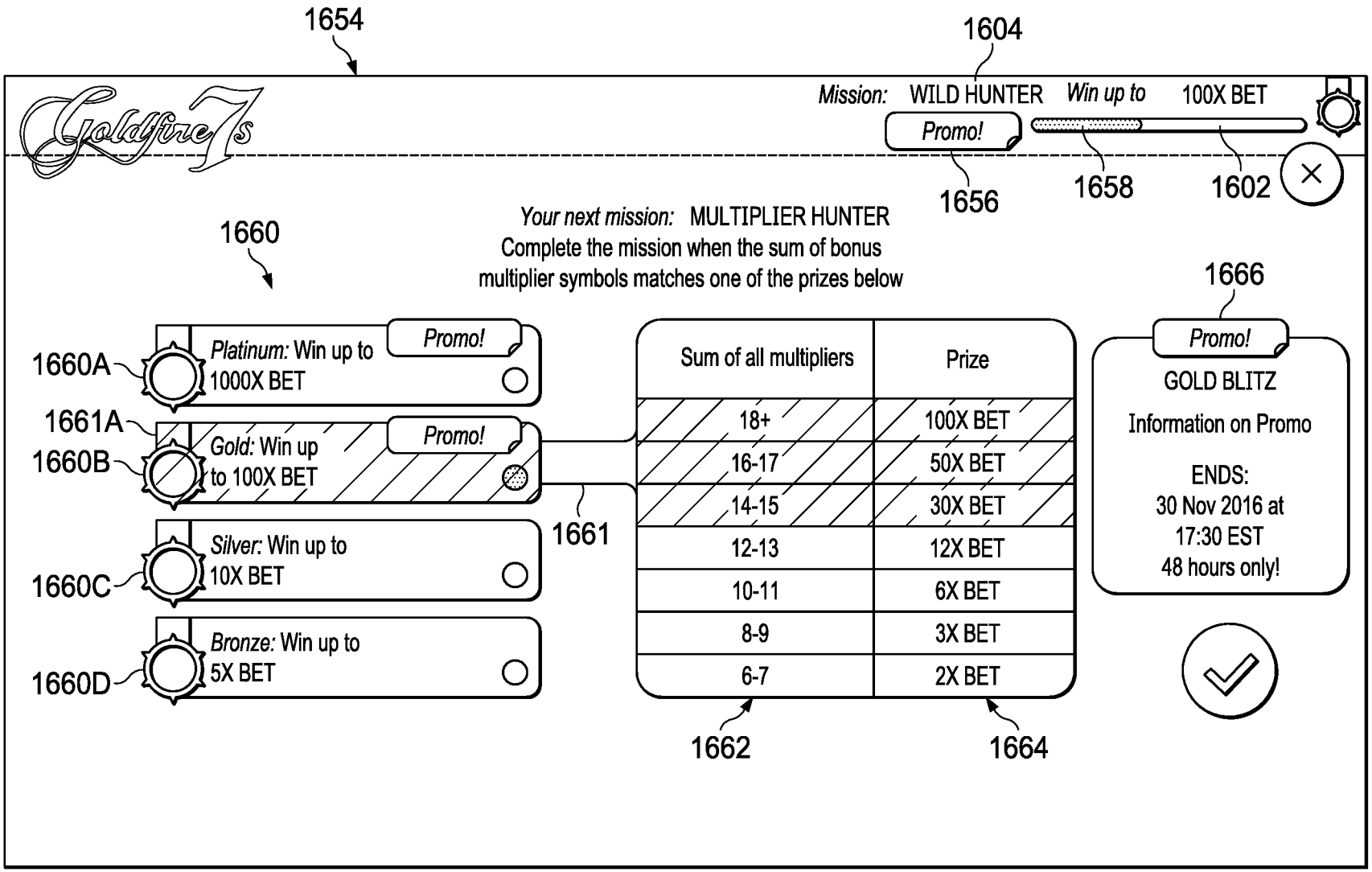
FIG. 16D is another illustration of game play, according to one embodiment.

In FIG. 16D, another illustration of game play is shown, according to one embodiment. A first promotional image 1654 includes the mission meter 1602, the mission objective area 1604, a promotional area 1656, a mission meter status indicator 1658, a player level area 1660, a plurality of levels for the objective area 1662, a plurality of prizes relating to the levels area 1664, and a promotional details area 1666. In this example, a player level area 1660 includes a bronze player level 1660D (e.g., first player level), a silver player level 1660C (a second player level), a gold player level 1660B (a third player level), and a platinum player level 1660A (a nth player level). There may be any number of player levels. In this example, the promotion relates to multiplier hunting where the number of multiplier obtained by a player dictates the prize amount. For example, if a player obtains 18 or more multipliers, than the prize is 100 times the bet amount (e.g., 100 credits times 100 multiplier equals 10,000 credits). In another example, if a player obtains 12-13 multipliers, than the prize is 12 times the bet amount.

In another example, a promotional program is initiated for the gold player level 1660B which is indicated by the shading 1661A of the area. This promotion indicates 1661 that the gold player level 1660B will obtain 100 times their bet for achieving 14-15 multipliers, 16-17 multipliers, and/or 18+ multiplier. Therefore, to obtain the top prize, the gold player level 1660B needs fewer multipliers because of the promotional procedure, program, and/or process. In this example, the promotional details area 1666 indicates that this promotion is for gold level players 1660B, that the promotion ends on Nov. 30, 2016 at 17:30 EST, and that the time remaining is 48 hours. In another example, the promotion may be cumulative and the mission meter status indicator 1658 indicates how much of the mission has been completed.

Figure 16E:
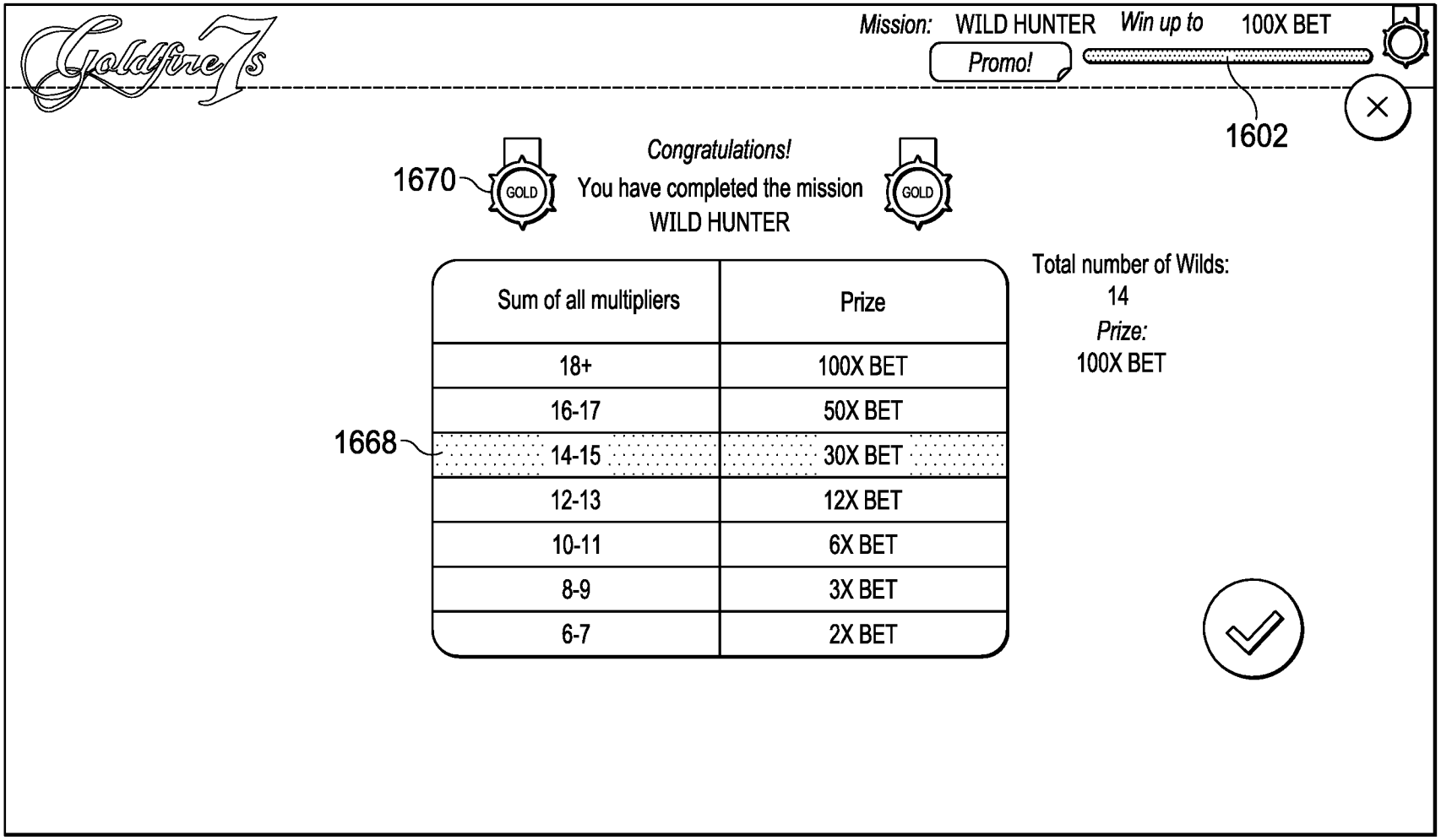
FIG. 16E is another illustration of game play, according to one embodiment.

In FIG. 16E, another illustration of game play is shown, according to one embodiment. In this example, the gold level player 1660B has achieved 14 multipliers before the promotional period had ended. Therefore, this player has achieved the top prize of 100 times their bet. Since the 14-15 multiplier level 1668 was part of the promotion 1661 which indicated that the top prize would be awarded for just 14 or more multipliers.

Figure 16F:
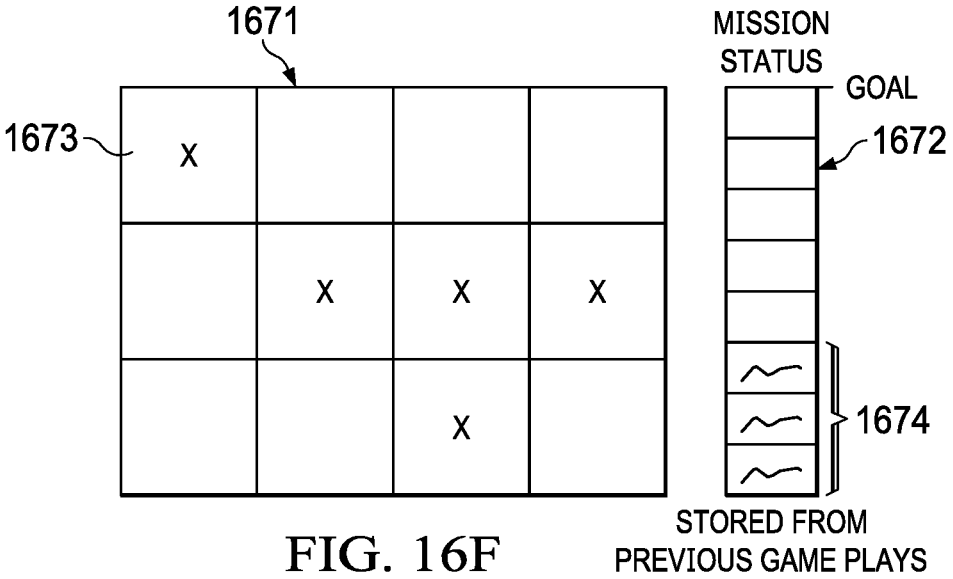
FIG. 16F is another illustration of game play, according to one embodiment.
Figure 16G:
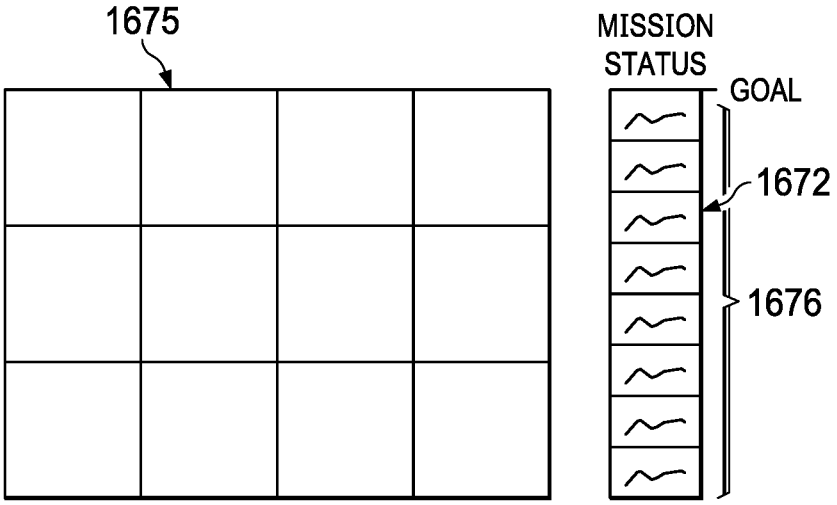
FIG. 16G is another illustration of game play, according to one embodiment.

In FIG. 16F, another illustration of game play is shown, according to one embodiment. In this example, a first game play 1671 shows that 5 mission criteria 1673 have been achieved during game play. Further, 3 mission criteria 1674 were achieved and stored from previous game plays. Therefore, in FIG. 16G, the mission goal 1672 has been completed because 8 mission criteria 1673 were required. There were 5 mission criteria 1673 achieved during the first game play 1671 and 3 mission criteria 1673 were stored 1674. Therefore, the player has achieved 8 mission criteria 1673 in total. In one example, the player may have the option to initiate a bonus game or store the achievements to potentially advance to a bigger bonus game. For example, if the player initiates the bonus game now at a first level, the top prize is 500 credits and the player has 10 bonus spins. However, if the player initiates the bonus game later at a second level, the top prize is 2000 credits and the player has 15 bonus spins. In addition, if the player initiates the bonus game later at an Nth level, the top prize is 100,000 credits and the player has 100 bonus spins.

Figure 17A:
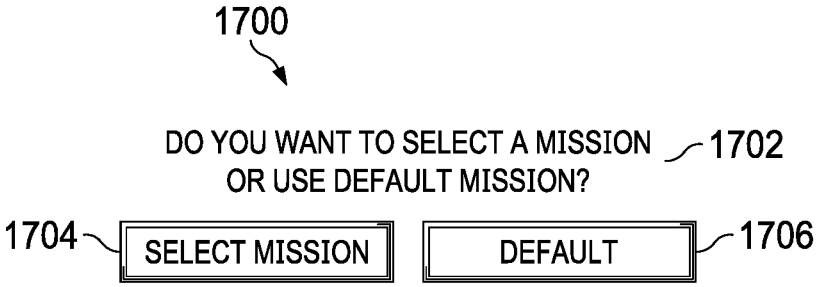
FIG. 17A is an illustration of a mission selection by a player, according to one embodiment.
Figure 17B:
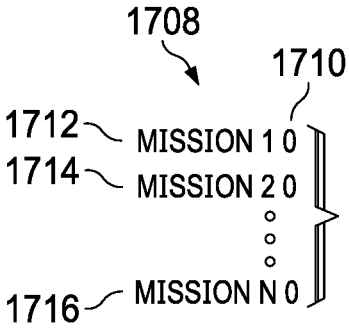
FIG. 17B is another illustration of a mission selection by a player, according to one embodiment.

In FIG. 17A, an illustration of a mission selection by a player is shown, according to one embodiment. A first selection image 1700 includes a message area 1702, a select mission button 1704, and a default mission button 1706. In this example, the message area 1702 states "Do you want to select a mission or use default mission?". If the player wants to utilize a default mission, the player selects the default mission button 1706 and/or a time period expires—if not selection is made after 30 seconds (and/or any other time period), the default mission is selected by the gaming device. If the player wants to select a mission, the player selects the select mission button and in FIG. 17B a list of missions 1708 is displayed. The list of missions 1708 includes a first mission 1712, a second mission 1714, and an Nth mission 1716. The player selects a mission via a radial button 1710 and/or any other selection process.

Figure 18:
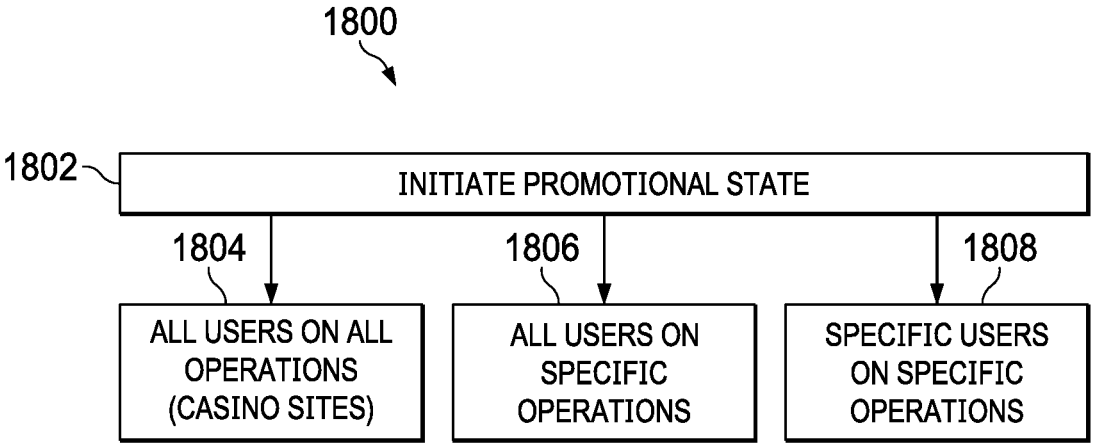
FIG. 18 is a flow diagram for promotional procedures, according to one embodiment.

In FIG. 18, a flow diagram for promotional procedures is shown, according to one embodiment. A method 1800 may include initiating one or more promotional states (step 1802). The method 1800 may include initiating one or more promotions for all users on all operations (casino sites) (step 1804). The method 1800 may include initiating one or more promotions for all users on specific operations (step 1806). The method 1800 may include initiating one or more promotions for specific users on specific operations (step 1808). For example, a first promotion (e.g., payouts and/or paytables increased by 1% (and/or 0.01%, . . . , 0.1%, . . . , 0.99%, . . . , 25.0%, etc.—note that all percentages are included by for brevity were not written out)) may be implemented for all users in all gaming cites (e.g., 1 to N game cites) for a first time period (e.g., next 1 minutes, . . . , next 5 minutes, . . . , next 10 minutes, . . . , next 2 hours, . . . , next 2 weeks, . . . , etc.—note that all time periods are included by for brevity were not written out) on a single game, a single game type, a few games, a few game types, a plurality of games, a plurality of game types, and/or all games.

In another example, a second promotion which included an increased payouts and/or paytables as noted above is implement for a second time period for all users but only at a limited number of game cites (e.g., 1 to 10) on a single game, a single game type, a few games, a few game types, a plurality of games, a plurality of game types, and/or all games.

In another example, a third promotion which included an increased payouts and/or paytables as noted above is implement for a third time period for a first type of users but only at a limited number of game cites (e.g., 1 to 10) on a single game, a single game type, a few games, a few game types, a plurality of games, a plurality of game types, and/or all games.

In another example, a fourth promotion which included an increased payouts and/or paytables as noted above is implement for a fourth time period for a first type of users at all game cites (e.g., 1 to N) on a single game, a single game type, a few games, a few game types, a plurality of games, a plurality of game types, and/or all games.

In another example, a fifth promotion which included an increased payouts and/or paytables as noted above is implement for a fifth time period for a first type of users at all game cites (e.g., 1 to N) on a single game, a single game type, a few games, a few game types, a plurality of games, a plurality of game types, and/or all games while a sixth promotion which included an increased payouts and/or paytables as noted above is implement for a fifth time period for a second type of users at all game cites on a single game, a single game type, a few games, a few game types, a plurality of games, a plurality of game types, and/or all games while an Nth promotion which included an increased payouts and/or paytables as noted above is implement for a fifth time period for an Nth type of users at all game cites on a single game, a single game type, a few games, a few game types, a plurality of games, a plurality of game types, and/or all games.

In another example, a first promotion which included an increased payouts and/or paytables as noted above is implement for a first time period for a first type of users at a single gaming cite on a single game, a single game type, a few games, a few game types, a plurality of games, a plurality of game types, and/or all games while a second promotion which included an increased payouts and/or paytables as noted above is implement for a first time period for a second type of users at a single game cite on a single game, a single game type, a few games, a few game types, a plurality of games, a plurality of game types, and/or all games while an Nth promotion which included an increased payouts and/or paytables as noted above is implement for a first time period for an Nth type of users at the single game cite on a single game, a single game type, a few games, a few game types, a plurality of games, a plurality of game types, and/or all games.

In another example, a first promotion which included an increased payouts and/or paytables as noted above is implement for a first time period for a single user (and/or a limited number of users, a user category (e.g., gold member), a user type (e.g., whale), and/or any combination of users) at all game cites (e.g., 1 to N) on a single game, a single game type, a few games, a few game types, a plurality of games, a plurality of game types, and/or all games.

In another example, a first promotion which included an increased payouts and/or paytables as noted above is implement for a first time period for a single user (and/or a limited number of users, a user category (e.g., gold member), a user type (e.g., whale), and/or any combination of users) at a limited number of game cites (e.g., 1 to 10) and/or one cite on a single game, a single game type, a few games, a few game types, a plurality of games, a plurality of game types, and/or all games.

In another example, a first promotion which included an increased payouts and/or paytables as noted above is implement for a first time period for a single user (and/or a limited number of users, a user category (e.g., gold member), a user type (e.g., whale), and/or any combination of users) at all game cites (e.g., 1 to N) on a single game, a single game type, a few games, a few game types, a plurality of games, a plurality of game types, and/or all games.

Figure 19A:
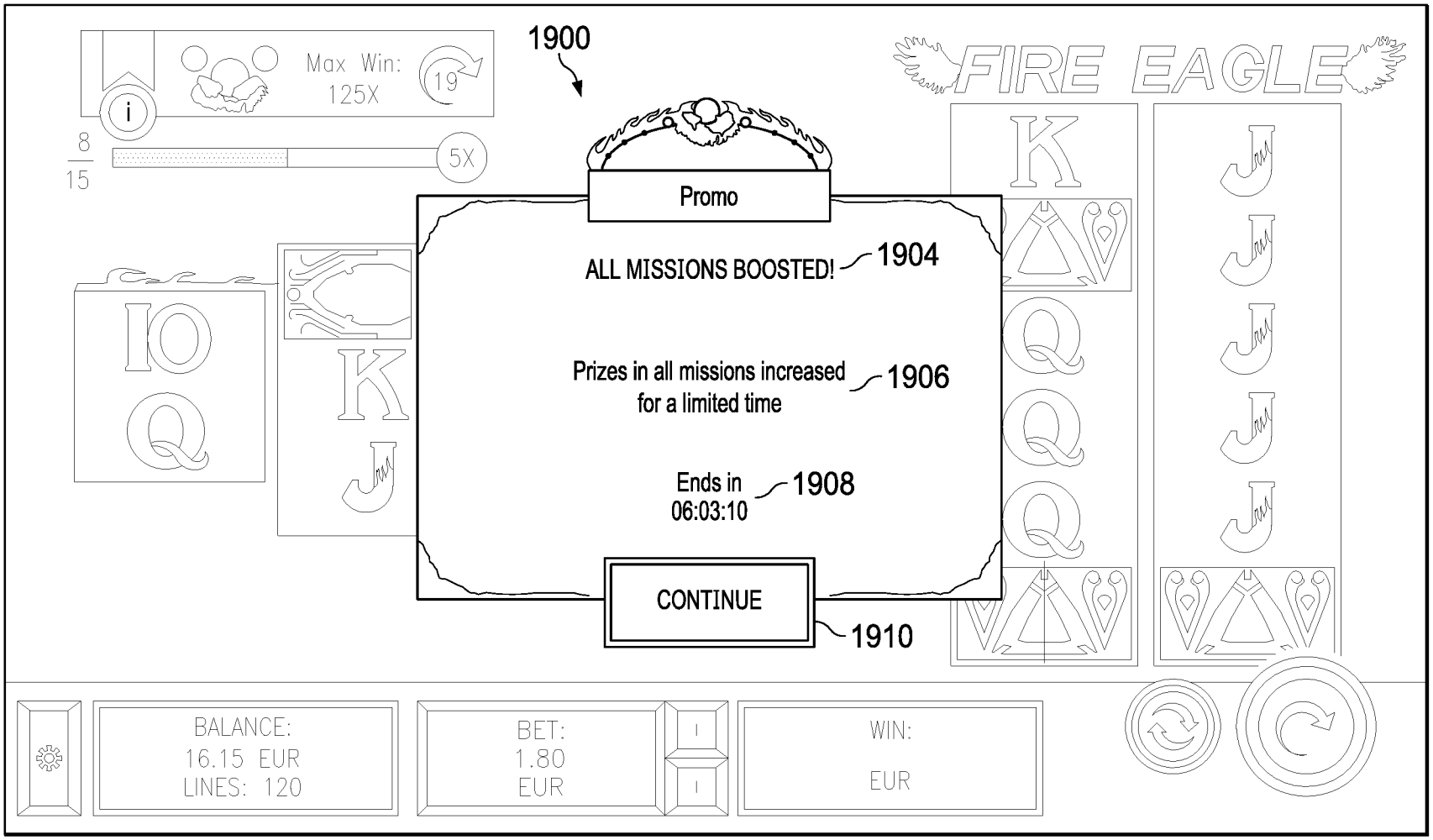
FIG. 19A is an illustration of game play, according to one embodiment.

In FIG. 19A, an illustration of promotional game play is shown, according to one embodiment. A first promotional screen 1900 includes a promotional title area 1902, a promotional headings area 1904, a promotional detail area 1906, a promotional time period area 1908, and a continue button 1910. In this example, a promotional headings area 1904 states that all missions are boosted during this promotion. Further, the promotional detail area 1906 states that prizes for all missions increased for a limited time. In addition, the promotional time period area 1908 states that the promotion ends in 6 hours, three minutes and 10 seconds from now.

Figure 19B:
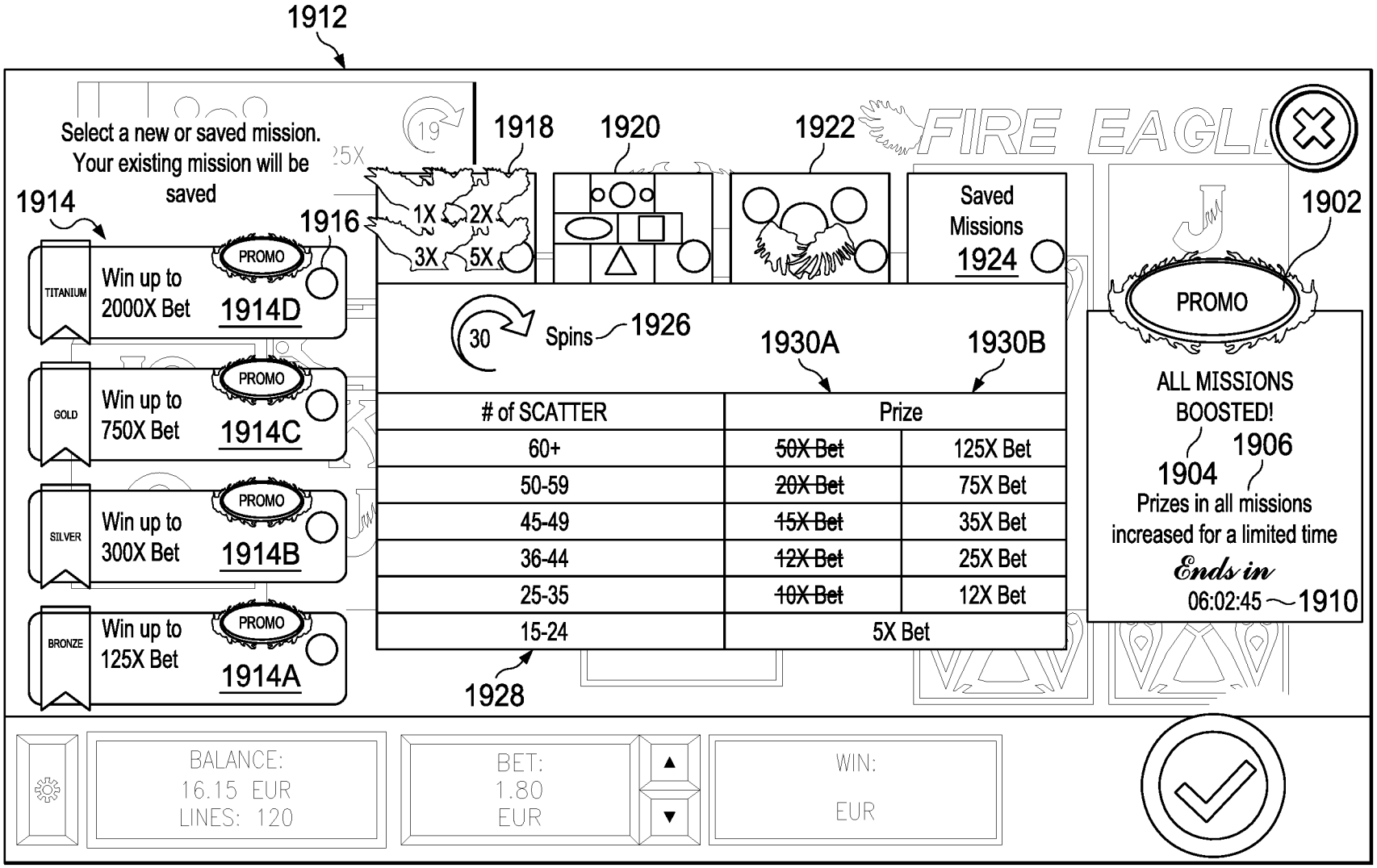
FIG. 19B is another illustration of game play, according to one embodiment.

In FIG. 19B, another illustration of promotional game play is shown, according to one embodiment. A second promotional screen 1912 includes a players' level 1914 with a first player level 1914A, a second player level 1914B, a third player level 1914C, and an Nth player level 1914D. Each player level has a promotional radial button 1916 for turning promotions on and off for each individual player level. In addition, a master promotional button may turn a promotion on for all player levels. In addition, the second promotional screen 1912 includes a first mission type area 1918, a second mission type area 1920, an Nth mission type area 1922, and a saved mission area 1924. In another example, a mission bonus may include a bonus spin function 1926. Further, an objective level area 1928 is shown with a plurality of objectives. In addition, a normal prize area 1930A is shown which is associated with the plurality of objectives during non-promotional time periods. Further, a promotional prize area 1930B is shown which is associated with the plurality of objectives during promotional game play time periods.

Figure 20A:
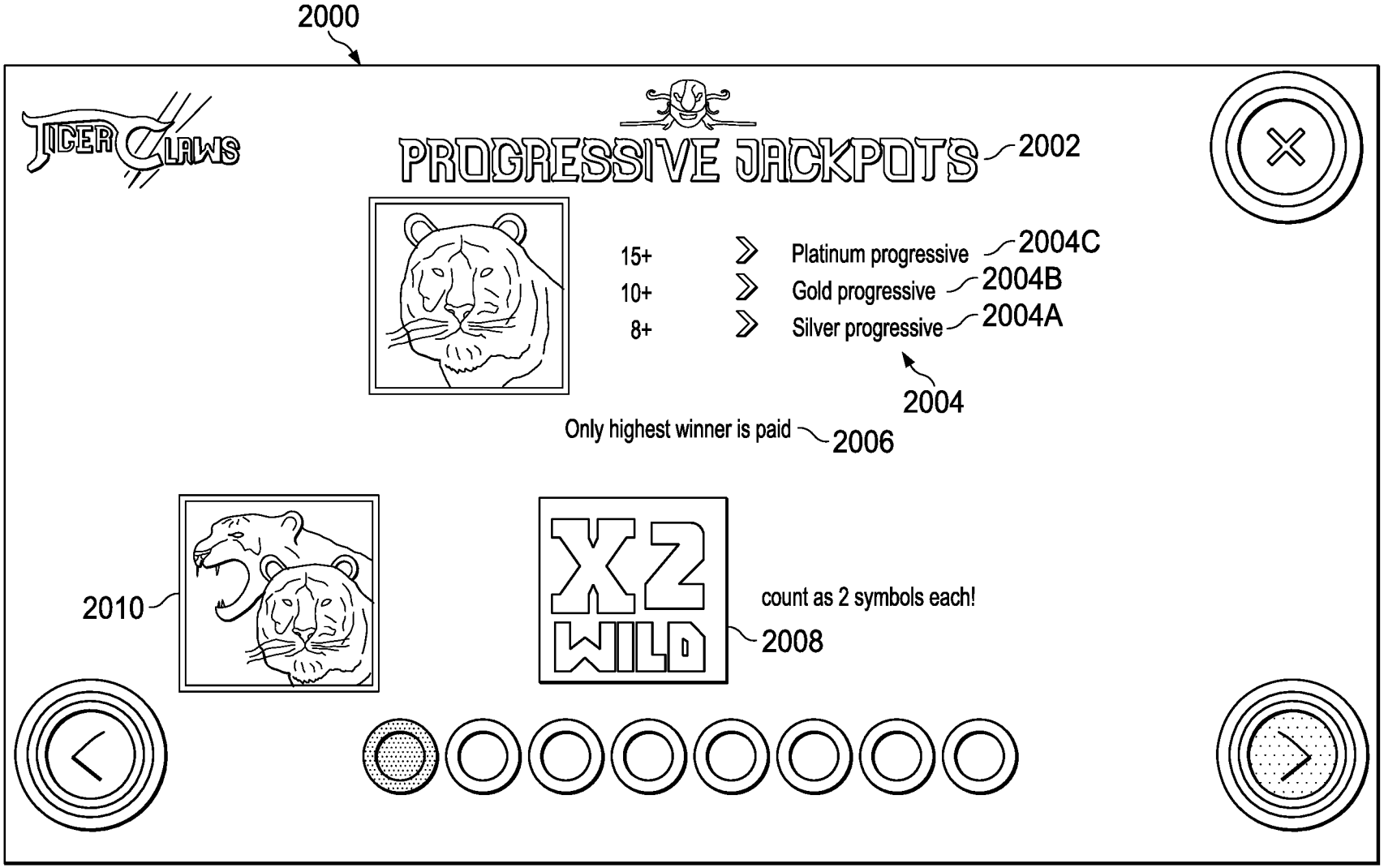
FIG. 20A is an illustration of game play, according to one embodiment.

In FIG. 20A, an illustration of progressive game play is shown, according to one embodiment. A first progressive screen 2000 shows a title area 2002 a player level area 2004, an objective area 2006, a first special symbol 2008, and an Nth special symbol 2010. In this example, the player level area 2004 includes a first player level 2004A, a second player level 2004B, and a third player level 2004C (and/or an Nth player level). In this example, the objective area 2006 states that the objective of this promotion is to get the highest winner because that is the only winner which will be paid.

Figure 20B:
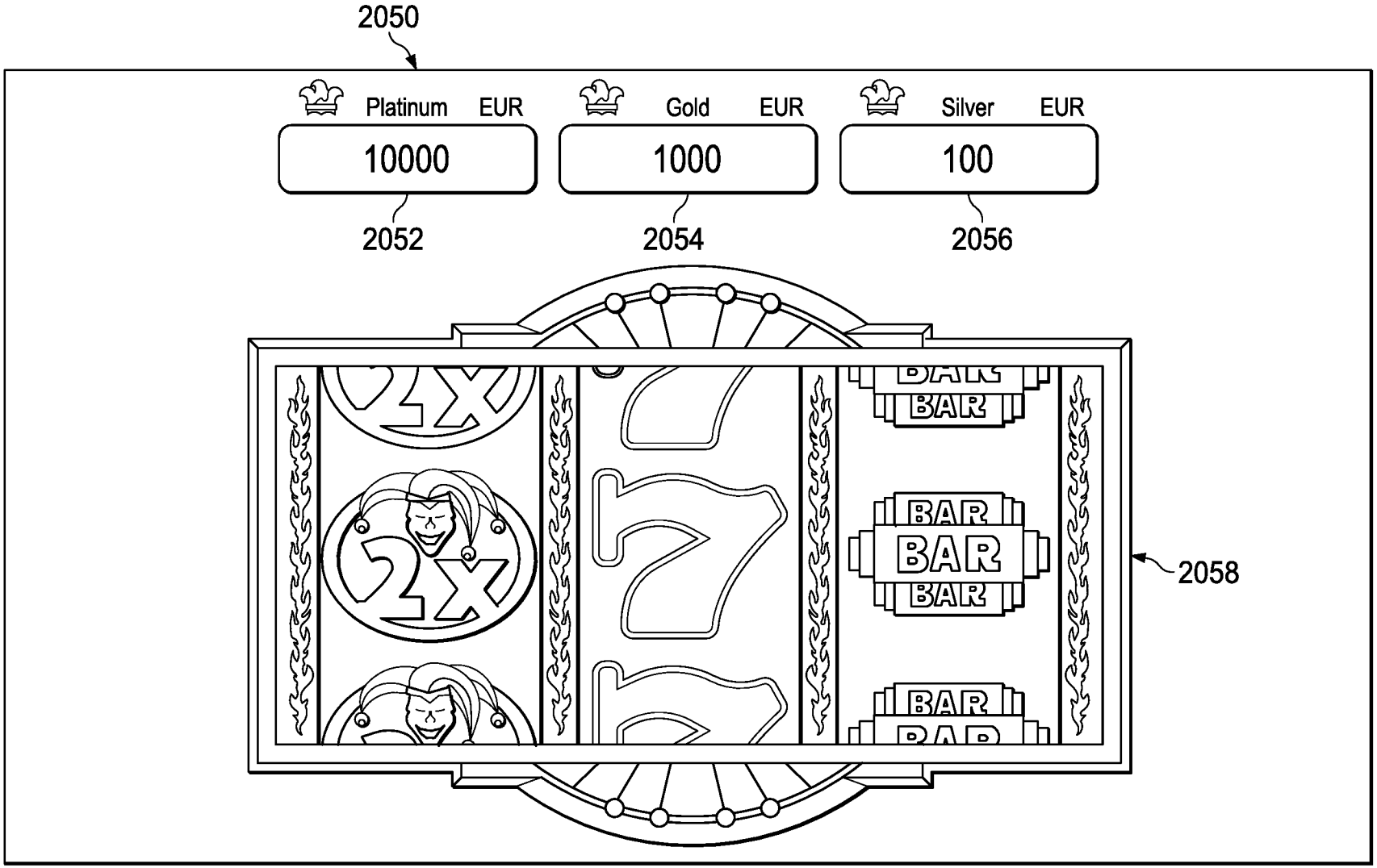
FIG. 20B is another illustration of game play, according to one embodiment.

In FIG. 20B, another illustration of game play is shown, according to one embodiment. A first game play screen 2050 include a first payout level 2056, a second payout level 2054, and a third payout level 2052 (and/or an Nth payout level) and/or a game play area 2058.

Figure 21:
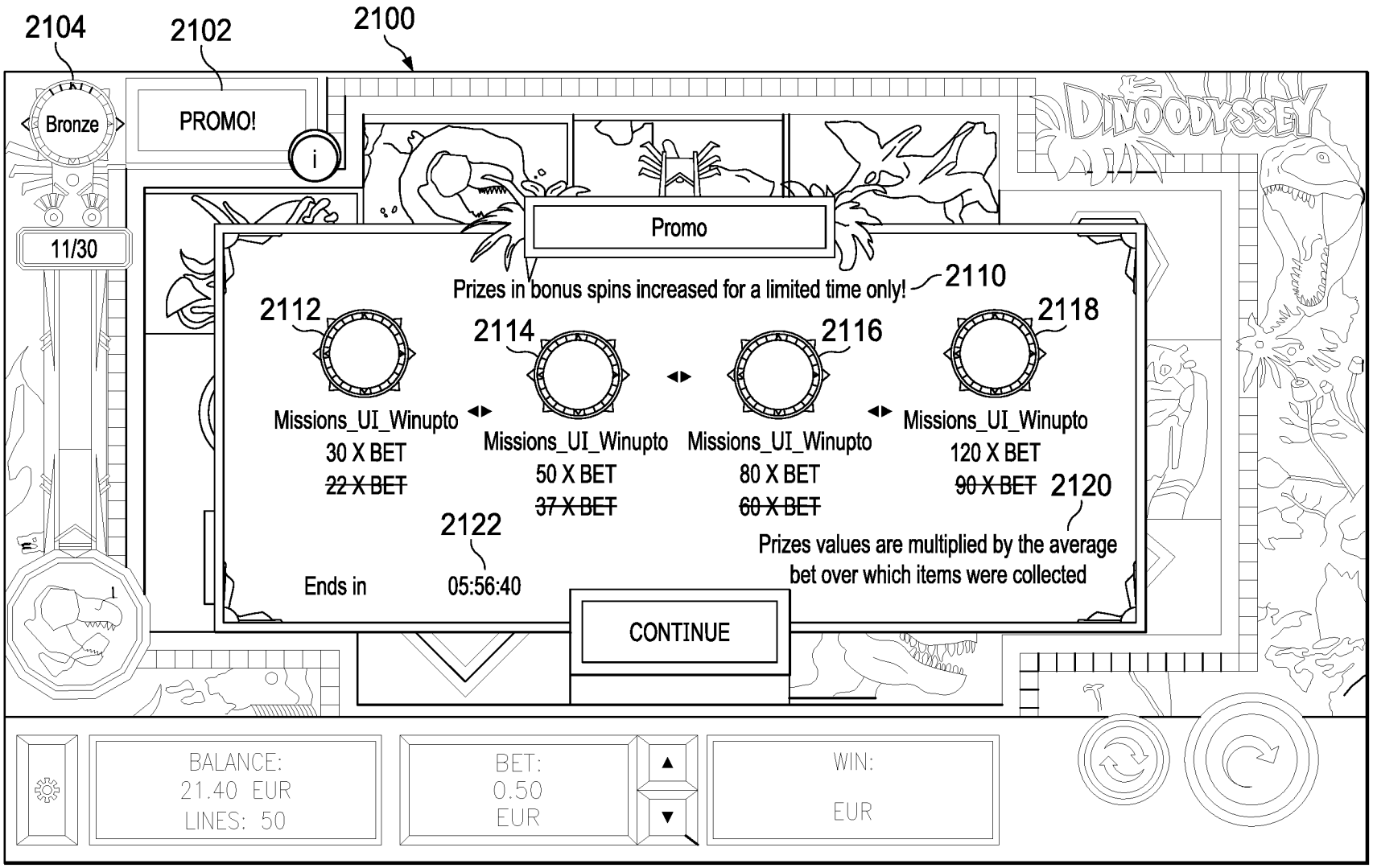
FIG. 21 is an illustration of game play, according to one embodiment.

In FIG. 21, an illustration of game play is shown, according to one embodiment. A first promotional image 2100 includes a promotion button 2102, a level indicator 2104, a first promotional area 2110, a second promotional area 2120, a promotional time clock 2122, a first mission area 2112, a second mission area 2114, a third mission area 2116, and an Nth mission area 2118. In this example, the first mission area 2112, the second mission area 2114, the third mission area 2116, and the Nth mission area 2118 all indicate that the payouts have increased during this promotion.

Figure 22:
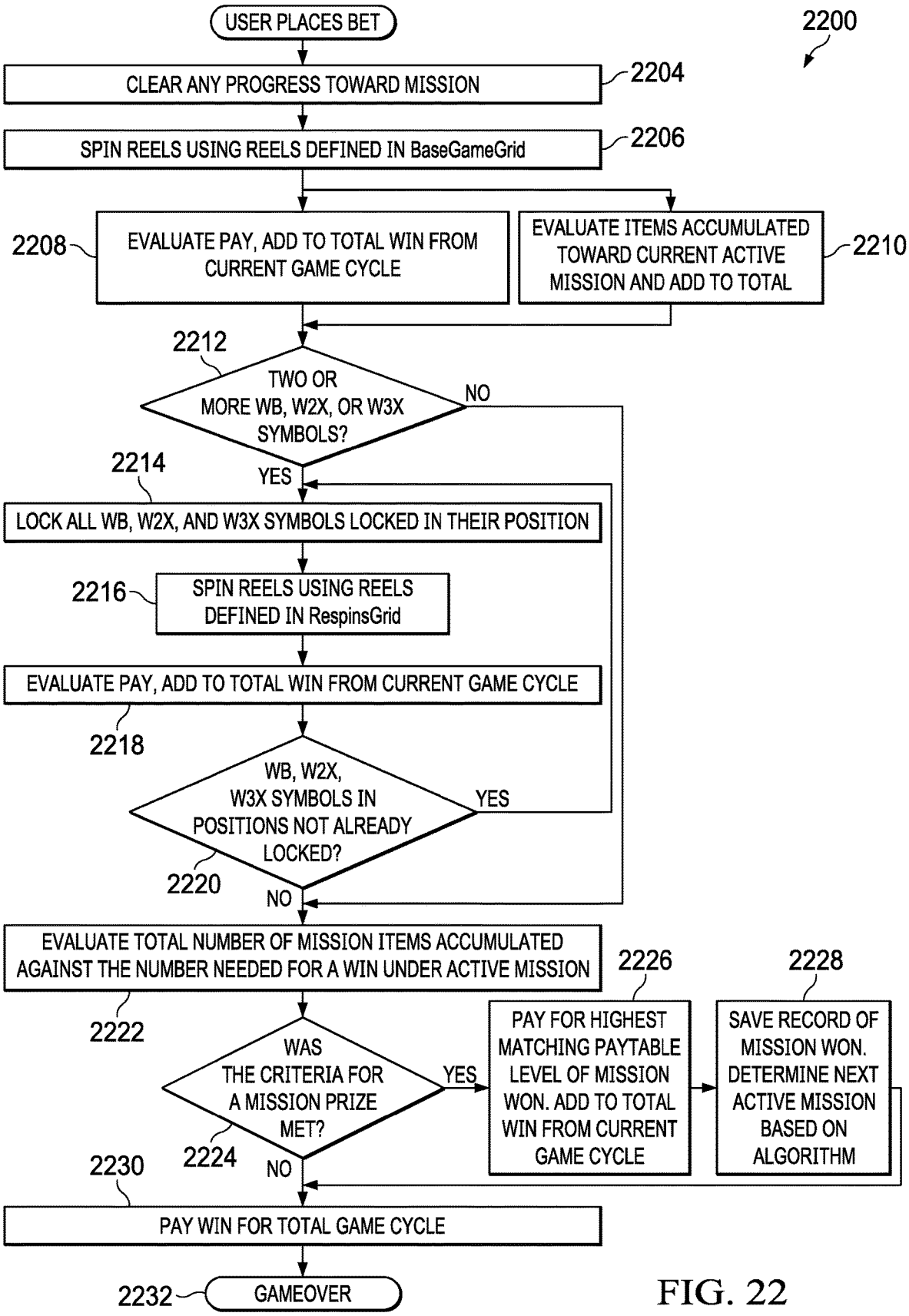
FIG. 22 is a flow diagram for game play, according to one embodiment.

In FIG. 22, a flow diagram for game play is shown, according to one embodiment. A method 2200 includes a user placing a bet (step 2202). The method 2200 may include clearing via one or more processors any progress toward mission (step 2204). The method 2200 may include spinning the reels using reel defined in based game grid (step 2206). The method 2200 may include evaluating via one or more processors pay, add to total win from current game cycle (step 2208). The method 2200 may include evaluating via one or more processors items accumulated towards the current active mission and adding to the total (step 2210). The method 2200 may determining via one or more processors whether there are two or more WB (Wild Bonus symbol), W2× (Wild and 2× Bonus symbol and/or symbols), or W3× symbols (Wild and 3× Bonus symbol and/or symbols) (step 2212). If there are not two or more WB, W2×, or W3× symbols, then move to step 2222. If there are two or more WB, W2×, or W3× symbols, then the method 2200 may include locking all WB, W2×, and W3× symbols in their position (step 2214). The method 2200 may include spinning reels using defined in respins grid (step 2216). The method 2200 may include evaluating pay, add to total win from current game cycle (step 2218). The method 2200 may include determining whether WB, W2×, W3× symbols in positions not already locked (step 2220). If WB, W2×, W3× symbols in positions not already locked, then the method 2200 moves back to step 2214. If WB, W2×, W3× symbols in positions that are already locked, then the method 2200 may include evaluating total number of mission items accumulated against the number needed for a win under active mission (step 2222). The method 2200 may include determining via one or more processors was the criteria for a mission prize met (step 2224). If the criteria for a mission prize was not met, then the method 2200 may include paying win for total game cycle (step 2230) and ending the game (step 2232). If the criteria for a mission prize were met, then the method 2200 may include paying for highest matching paytable level of mission won and adding to total win from current game cycle (step 2226). The method 2200 may include saving record of mission won and determining next active mission based on algorithm (step 2228) and moving to step 2230. Please note that any symbols may be used. A NX Bonus symbol where N is any number from 1.1 to infinity. In addition, the Wild symbol may be a normal wild, an expanding wild, and/or any other wild symbol. Further, in some embodiments, an important aspect may be that the collection of specific symbols in different slot games where the symbols involved may change completely and/or may change completely from mission to mission and/or from level to level. In addition, the collection of individual symbols may be unweighted, weighted, and/or any combination thereof. For example, in a first mission, a first level, and/or a first game type, the collection symbols may be weighted while in a second mission, a second level, and/or a second game type, the collection symbols may be unweighted. In another example, in a first mission, a first level, and/or a first game type, the a first collection symbol may be weighted and a second collection symbol may be unweighted while in a second mission, a second level, and/or a second game type, the first collection symbol may be unweighted and the second collection symbol may be weighted. In another example, in a first mission, a first level, and/or a first game type, the a first collection symbol may be weighted and a second collection symbol may be unweighted while in a second mission, a second level, and/or a second game type, the first collection symbol may be unweighted and the second collection symbol may be unweighted. Therefore, different symbol schemes may be used but each symbol may have different weights. Further, any number of symbols could be used. For example, Symbol 1 which is weighted at a first weighting, Symbol 2 which is weighted at a second weighting, Symbol 3 which is weighted at a third weighting, and/or Symbol N which is weighted at an Nth weighting. All of these weightings may be different, one may be the same as another, a few may be the same, a plurality may be the same, and/or any combination thereof for any mission, game level, game type, and/or any combination thereof.

Figure 23:
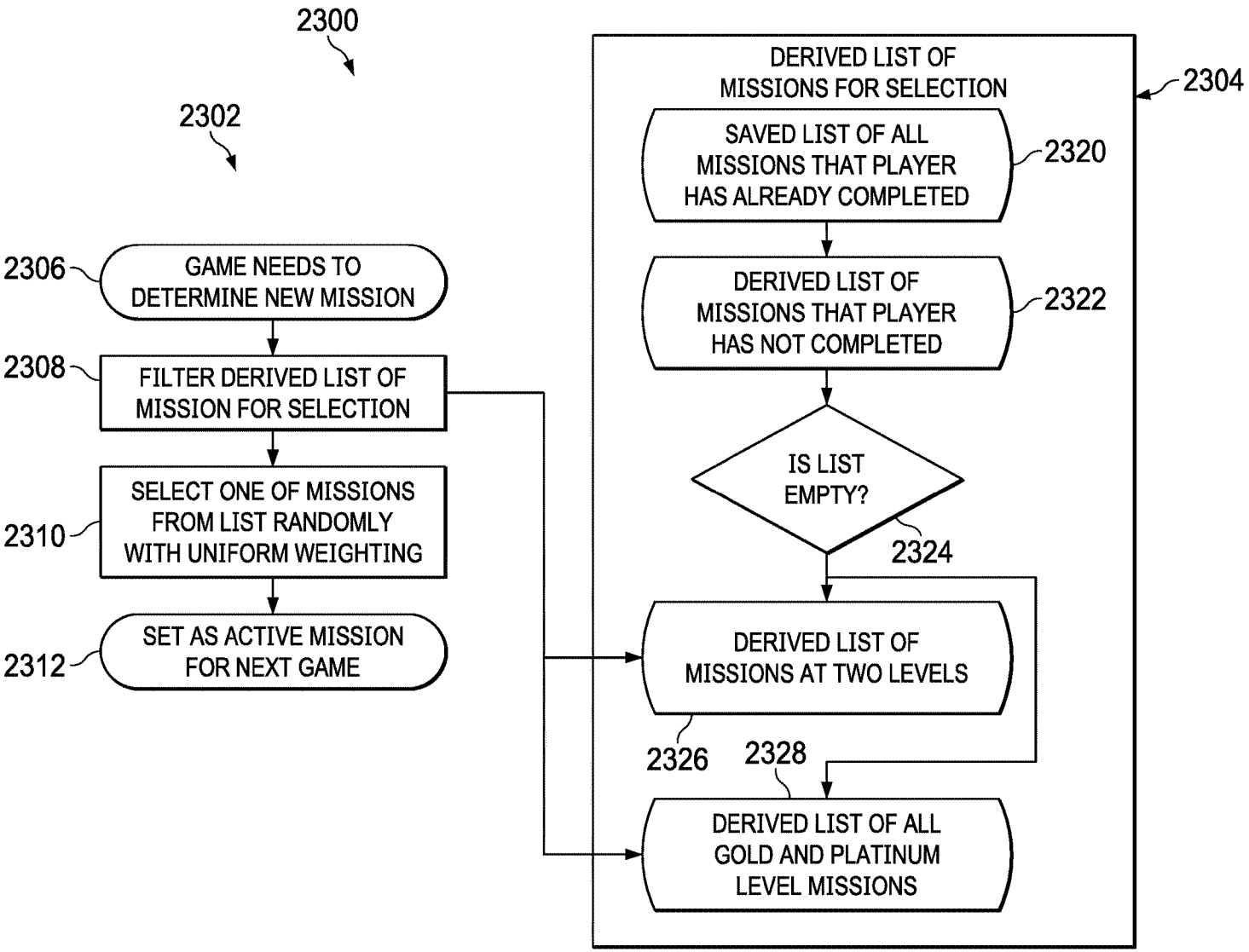
FIG. 23 is a flow diagram for game play, according to one embodiment.

In FIG. 23, a flow diagram for game play is shown, according to one embodiment. A first method 2302 may include the game via one or more processors determining that a new mission is needed (step 2306). The first method 2302 may include filtering a derived list of mission for selection (step 2308). The first method 2302 may include selecting one of the missions from a list randomly with uniform weighting (step 2310). The first method 2302 may include setting as active mission for next game play (step 2312). The first method 2302 may include selecting one or more missions from a uniformly weighted list, a weighted list, allowing the player to select one or more missions for a level list (e.g., missions are tied to a specific achievement level), allowing the player to select one or more missions for a level list, allowing the gaming device to select one or more missions for a level list (e.g., missions are tied to a specific achievement level), and/or any combination thereof.

A second method 2304 may relate to derived list of missions for selection. The second method 2304 may include compiling the saved list of all missions that the player has already completed (step 2320). The second method 2304 may include deriving a list of missions that the player has not completed (step 2322). The second method 2304 may include determining whether the list is empty (e.g., no missions left in the list) (step 2324). The second method 2304 may include deriving a list of missions at level two (and/or two levels) (step 2326). The second method 2304 may include deriving a list of all gold (a specific level—N-1 level) and platinum level missions (a specific level—an Nth level) (step 2328).

Figure 24A:
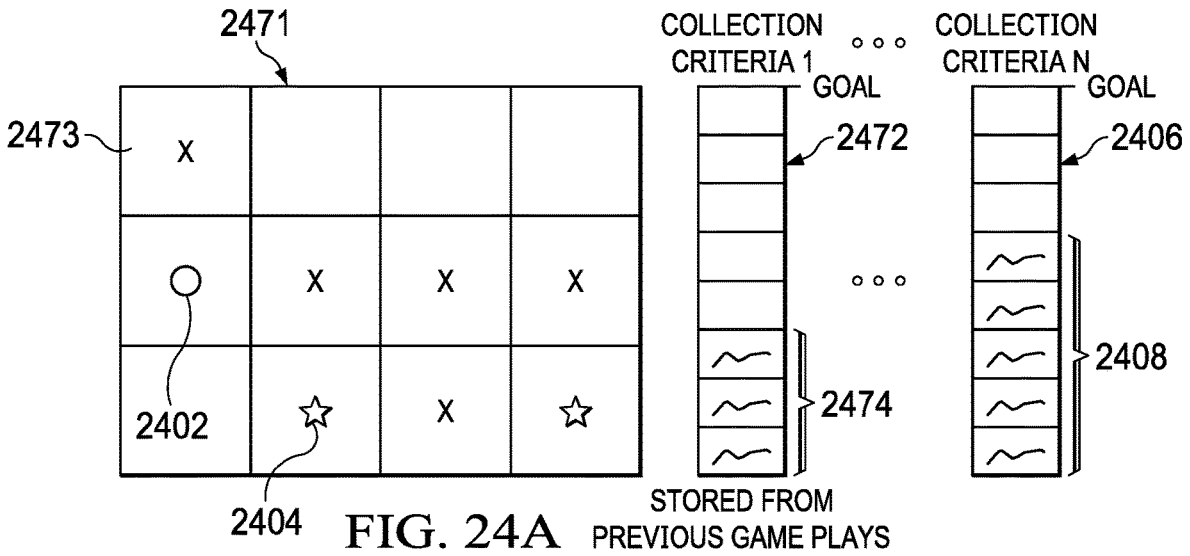
FIG. 24A is an illustration of game play, according to one embodiment.
Figure 24B:
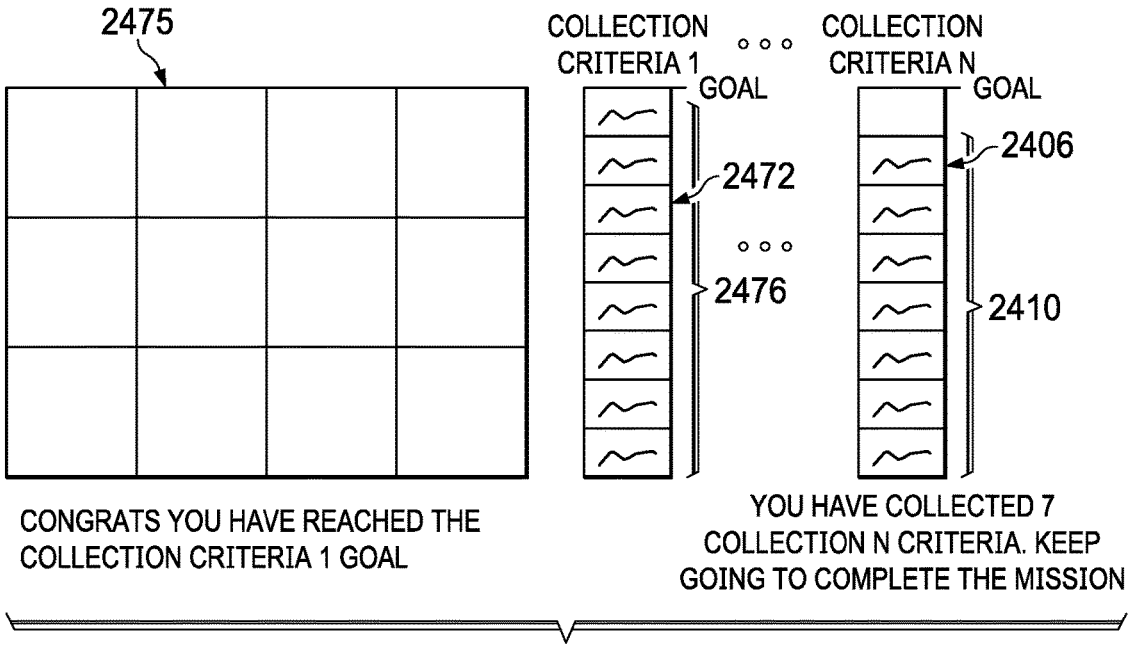
FIG. 24B is another illustration of game play, according to one embodiment.

In FIG. 24A, an illustration of game play is shown, according to one embodiment. In this example, a first game play 2471 has generated 5 of a first collection criteria symbols 2473, a plurality of non-collection criteria symbols 2402 and 2 of an Nth collection criteria symbols 2404. Since a first collection criteria symbol status bar 2472 already had 3 saved first collection criteria symbols 2474 and 8 first collection criteria symbols 2473 are needed for this mission, the first collection criteria symbol status bar 2472 is shown as a full first collection criteria status bar 2476 in FIG. 24B. Further, the first game play 2471 has generated 2 of an Nth collection criteria symbols 2402. Since an Nth collection criteria symbol status bar 2406 already had 5 saved Nth collection criteria symbols 2408 and 8 Nth collection criteria symbols are needed for this mission, the Nth collection criteria symbol status bar 2406 is shown as only a partial full Nth collection criteria status bar 2410 in FIG. 24B. Since the first collection criteria is full but the Nth collection criteria is not full, the mission is incomplete and continues in the next game play, for a number of game plays, and/or resets. In one example, the game is configured with a list of possible collection criteria from one of the previously defined missions and/or any combination of these types. For example, collect 100 G7 symbols, 50 WB symbols, and/or 100 R7 symbols.

Figure 25:
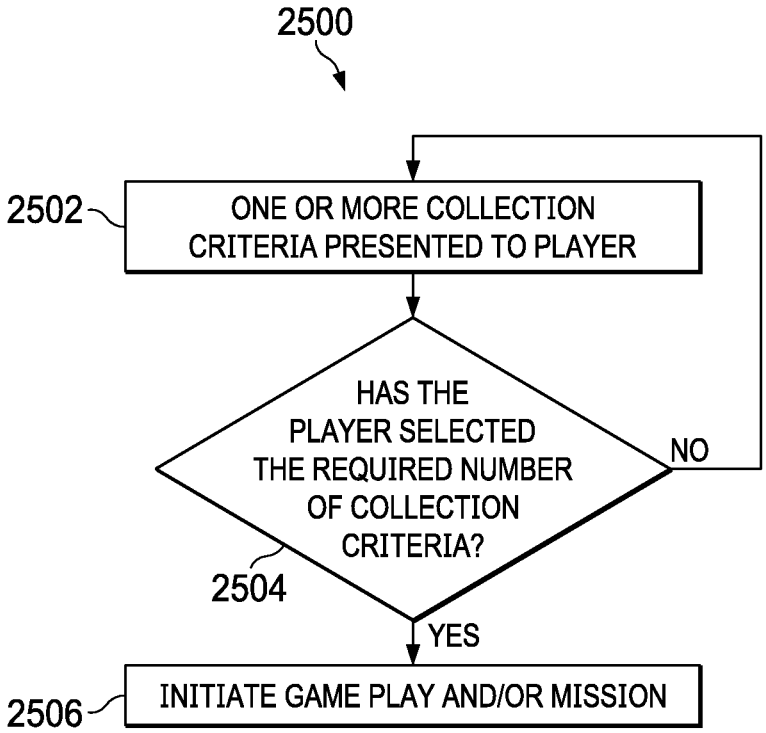
FIG. 25 is a flow diagram of game play, according to one embodiment.

In FIG. 25, a flow diagram of game play is shown, according to one embodiment. A method 2500 may include one or more collection criteria being presented to the player (step 2502). The method 2500 may include determining via one or more processors whether the player has selected the required number of collection criteria (step 2504). If the player has not selected the required number of collection criteria, the method 2500 moves back to step 2502. If the player has selected the required number of collection criteria, then the method 2500 may initiate game play and/or mission play (step 2506).

In one example, before a mission begins, the game selects a combination of collection criteria for the game play and then the player must make an input to accept or decline the mission. In some cases, the game, the gaming system, the gaming device, and/or any combination thereof may make and/or generate multiple such selections and present a player with options (A), (B) or (C). In case of accept/reject flow, the player may reject offers until the player receives an offer they wish to accept. In a multiple choice flow, the player must choose one of the available options.

Figure 26A:
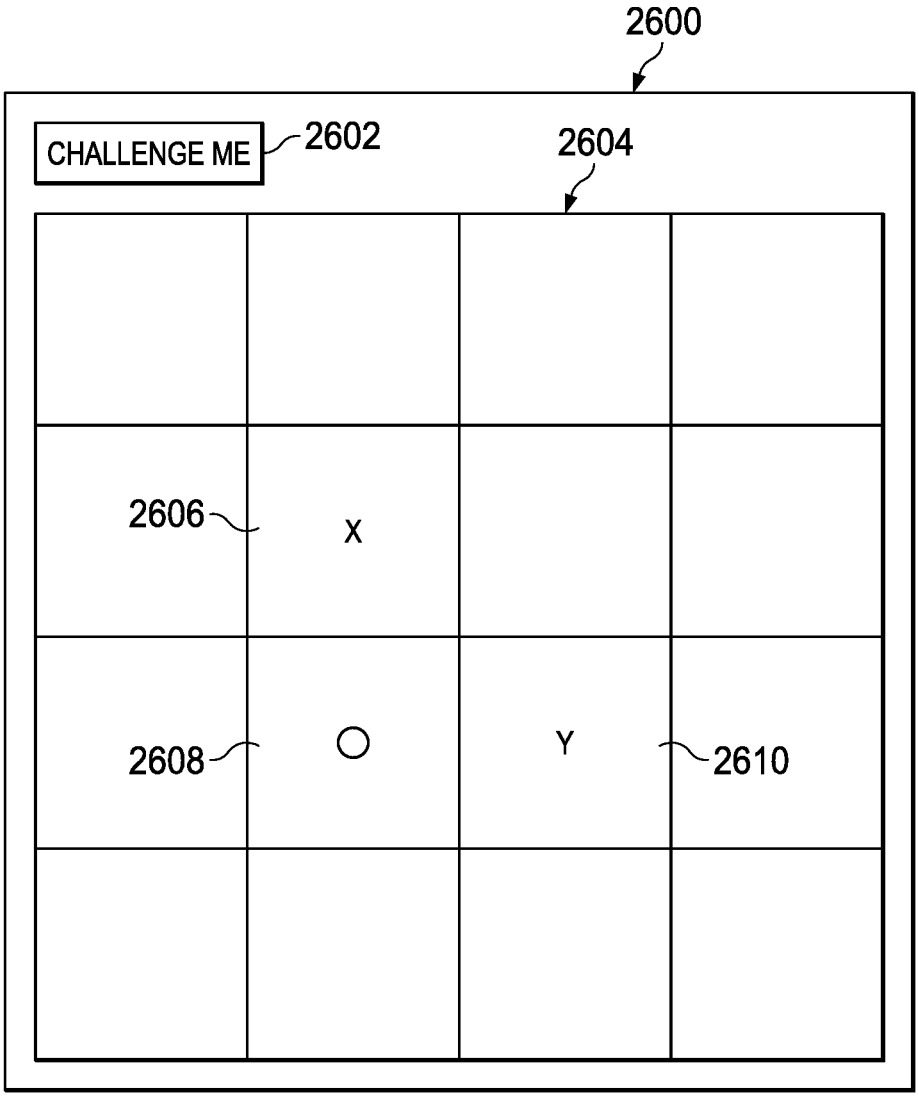
FIG. 26A is an illustration of game play, according to one embodiment.

In FIG. 26A, an illustration of game play is shown, according to one embodiment. In this example, a first game play 2600 may show a game board 2604 with a first symbol 2606, a second symbol 2608, an Nth symbol 2610, and a challenge me button 2602. In one case, this "Challenge Me" function is a mission as described in earlier embodiments that is always available; in this case, it would have a promotional state that is an increased prize on one or several of the mission prizes.

Figure 26B:
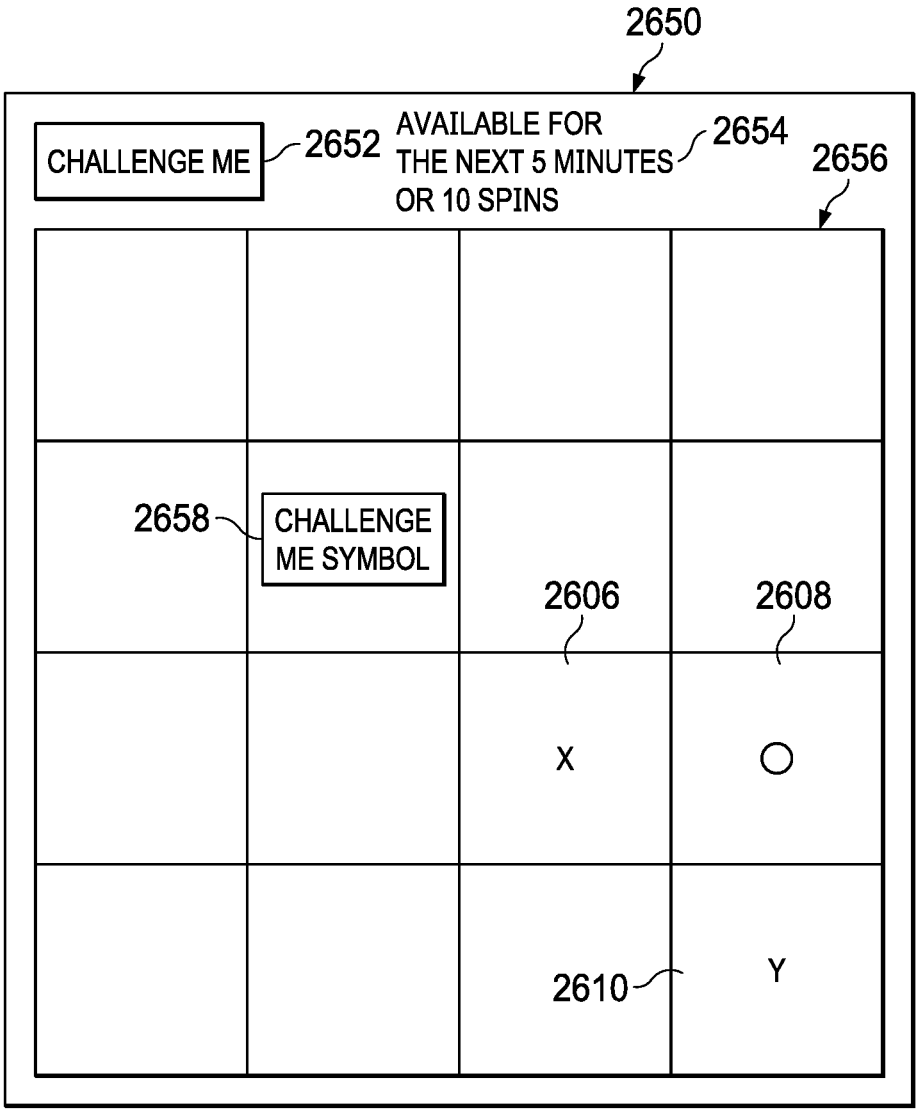
FIG. 26B is another illustration of game play, according to one embodiment.

In FIG. 26B, an illustration of game play is shown, according to one embodiment. In this example, a second game play 2650 may show a second game board 2656 with the first symbol 2606, the second symbol 2608, the Nth symbol 2610, and a challenge me button 2652. In this example, the challenge me button 2652 is only available for the next five minutes and/or the next 10 spins 2654. In addition, the challenge me button 2652 may be activated by one or more of the first symbol 2606, the second symbol 2608, the Nth symbol 2610, a challenge me symbol 2658, and/or any combination thereof. In another case, the challenge me button 2652 and/or functionality is a promotional state that is available for a limited time only, for select players, for a specific players, for a player category, for a few player categories, for all player categories, for a player level, for a few player levels, for all player levels, for a gaming site, for a few gaming sites, and/or all gaming sites. In one example, the challenge me symbol 2658 may have two functions, such as, a challenge me function to initiate and/or present the challenge me option to the player and a symbol payout function. For example, if the player does not elect to utilize the challenge me function, the challenge me symbol 2658 may convert into another symbol (e.g., symbol 1, a bonus symbol, a wild symbol, a multiplier symbol, a scatter symbol, etc. and/or any combination thereof).

In another embodiment, a mission selection algorithm may be based on player betting habits:

Multiple mission selection algorithms

Configurable as a global parameter in the deployed game

Configurable as a parameter that is global to all players from a given operator.

Configurable as a parameter that is assigned to specific players or segments

Adaptive mission selection algorithms based on player data.

Adapting the mission selection algorithm based on player behavior data, such as betting habits as you mentioned.

Adapting the mission selection algorithm based on operator marketing strategies.

Adapting based on a combination of the above.

In one embodiment, the electronic gaming device management system includes a memory including one or more promotional gaming structures, one or more processors configured to implement the one or more promotional gaming structures where the one or more promotional gaming structures including a first promotional gaming structure relating to a first gaming site.

In another example, the electronic gaming device management system includes a second promotional gaming structure relating to a plurality of gaming sites. In another example, the electronic gaming device management system includes a third promotional gaming structure relating to a subset of gaming sites. In another example, the electronic gaming device management system includes a fourth promotional gaming structure relating to a first player category. In another example, the fourth promotional gaming structure is implemented for the first player category in the first gaming site, the plurality of gaming sites, and/or the subset of gaming sites. In another example, the one or more promotional gaming structures includes a fifth promotional gaming structure relating to the first player category and a second player category, wherein the fifth promotional gaming structure is implemented for the first player category in the first gaming site and the fifth promotional gaming structure is implemented for the second player category in a second gaming site. In another example, the fifth promotional gaming structure is implemented for the first player category in the first gaming site for a first time period and the fifth promotional gaming structure is implemented for the second player category in a second gaming site for the first time period. In another example, the fifth promotional gaming structure is implemented for the first player category in the first gaming site for a first time period and the fifth promotional gaming structure is implemented for the second player category in a second gaming site for a second time period.

In another embodiment, an electronic gaming device includes a plurality of display areas, one or more paylines formed on at least a portion of the plurality of display areas, a memory, the memory including one or more mission game play structures, and a processor configured to initiate the one or more mission game play structures where the processor is configured to determine a mission outcome for a mission game play and display a mission status on a mission meter.

In another example, an initiated mission game play structure is based on one or more criteria selections. In another example, an initiated mission game play structure is based on a selection by a player. In another example, a mission achievement carries over to a next game play. In another example, a mission achievement is reset to a baseline for a next game play. In another example, the one or more mission game play structures are tied to one or more mission levels. In another example, a first mission, a second mission, and a third mission are in a first mission level, a fourth mission, a fifth mission, and a sixth mission are in a second mission level, and a seventh mission, an eighth mission, and an N-1 mission are in a Nth mission level. In another example, the processor is configured to initiate the second mission level based on the first mission, the second mission, and the third mission being completed, the processor further configured to initiate the Nth mission level based on the first mission, the second mission, the third mission, the fourth mission, the fifth mission, and the sixth mission being completed.

In another embodiment, an electronic gaming system includes a server including a server memory and a server processor, the server memory including one or more promotional gaming structures and the server processor is configured to implement the one or more promotional gaming structures, where the one or more promotional gaming structures are displayed on one or more electronic gaming devices, the one or more promotional gaming structures including a first promotional gaming structure relating to a first gaming site.

In another example, the one or more promotional gaming structures include a second promotional gaming structure relating to a plurality of gaming sites. In another example, the one or more promotional gaming structures include a third promotional gaming structure relating to a subset of gaming sites. In another example, the one or more promotional gaming structures include a fourth promotional gaming structure relating to a first player category. In another example, the fourth promotional gaming structure is implemented for the first player category in at least one of the first gaming site, the plurality of gaming sites, and the subset of gaming sites.

The most likely scenario is that we would design multiple selection algorithms (say 4)—some with higher weighting toward higher-level (i.e. more difficult, more aggressive) missions, some with more weighting elsewhere. Another dimension of varying the mission selection is the speed of advancement—that is, some algorithms may progress more slowly from weighting the lower levels to the higher levels; others may progress very quickly. This can be accomplished by filtering the missions from the available list differently, and by assigning a non-uniform weight to the different missions.

In one embodiment, the gaming system either physical or virtual may accept a wager using virtual currency (i.e. social casino).

Gaming system may be a "state-based" system. A state-based system stores and maintains the system's current state in a non-volatile memory. Therefore, if a power failure or other malfunction occurs, the gaming system will return to the gaming system's state before the power failure or other malfunction occurred when the gaming system is powered up.

State-based gaming systems may have various functions (e.g., wagering, payline selections, reel selections, game play, bonus game play, evaluation of game play, game play result, steps of graphical representations, etc.) of the game. Each function may define a state. Further, the gaming system may store game histories, which may be utilized to reconstruct previous game plays.

A state-based system is different than a Personal Computer ("PC") because a PC is not a state-based machine. A state-based system has different software and hardware design requirements as compared to a PC system.

The gaming system may be an online system with the following components: client device (a PC or mobile, or even an electronic gaming machine such as a lottery terminal) where the game is displayed and where user interaction is received; client software, which is either preloaded on the client device or downloaded when the user initiates the game; a network connection, such as the internet, over which content, user interaction, and game results are sent; server hardware; server software which processes game results for individual bets; a database or other repository of persisted game, user, configuration, and promotional award data; and an account management system, which stores player information such as cash available and identity information (name, address, etc.).

The gaming system may include random number generators, authentication procedures, authentication keys, and operating system kernels. These devices, modules, software, and/or procedures may allow a gaming authority to track, verify, supervise, and manage the gaming system's codes and data.

A gaming system may include state-based software architecture, state-based supporting hardware, watchdog timers, voltage monitoring systems, trust memory, gaming system designed communication interfaces, and security monitoring.

For regulatory purposes, the gaming system may be designed to prevent the gaming system's owner from misusing (e.g., cheating) via the gaming system. The gaming system may be designed to be static and monolithic.

In one example, the instructions coded in the gaming system are non-changeable (e.g., static) and are approved by a gaming authority and installation of the codes are supervised by the gaming authority. Any change in the system may require approval from the gaming authority. Further, a gaming system may have a procedure/device to validate the code and prevent the code from being utilized if the code is invalid. The hardware and software configurations are designed to comply with the gaming authorities' requirements.

As used herein, the term "mobile device" refers to a device that may from time to time have a position that changes. Such changes in position may comprise of changes to direction, distance, and/or orientation. In particular examples, a mobile device may comprise of a cellular telephone, wireless communication device, user equipment, laptop computer, other personal communication system ("PCS") device, personal digital assistant ("PDA"), personal audio device ("PAD"), portable navigational device, or other portable communication device. A mobile device may also comprise of a processor or computing platform adapted to perform functions controlled by machine-readable instructions.

The methods and/or methodologies described herein may be implemented by various means depending upon applications according to particular examples. For example, such methodologies may be implemented in hardware, firmware, software, or combinations thereof. In a hardware implementation, for example, a processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the detailed description included herein are presented in terms of algorithms or symbolic representations of operations on binary digital signals stored within a memory of a specific apparatus or a special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the arts to convey the substance of their work to others skilled in the art. An algorithm is considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Reference throughout this specification to "one example," "an example," "embodiment," and/or "another example" should be considered to mean that the particular features, structures, or characteristics may be combined in one or more examples. While there has been illustrated and described what are presently considered to be example features, it will be understood by those skilled in the art that various other modifications may be made, and equivalents may be substituted, without departing from the disclosed subject matter. Additionally, many modifications may be made to adapt a particular situation to the teachings of the disclosed subject matter without departing from the central concept described herein. Therefore, it is intended that the disclosed subject matter not be limited to the particular examples disclosed. Further, one or more gaming options may be Internet based gaming options. Therefore, all of the examples and/or embodiments may be utilized via an Internet based gaming system.

This is a game feature and promotions system designed for casino games with online/mobile casinos. The design can be applied to brick and mortar casino systems, especially those in which user data can be stored. The main design is with a slot machine game in mind but can be used with other games.

In various examples, missions general functionality may include: on every spin, there is 1 mission active, according to one embodiment; each mission, according to one embodiment, is defined with a Name—the logical name of the mission; a category—a name for the group of missions to which it belongs; a level —bronze, silver, gold, or platinum; a paytable; a list of paytable levels; each paytable level has an associated prize and a requirement for winning that level; and/or mission progress, according to one embodiment, is stored within a game cycle (a base game spin plus any triggered respins).

The mission prize may be determined at the end of the game cycle by evaluating the number of accumulated items toward the active mission against the paytable for the mission. The mission prize may be the paytable value multiplied by the total bet on the initiating game. At most, according to one embodiment, one mission prize is awarded per game cycle. After a mission is awarded, the game automatically selects a new active mission, according to one embodiment. Before a bet is placed, a player can change the active mission via a menu in the main game, however the player may only select from different levels of mission within the same category, according to one embodiment. Mission progress and the items accumulated on each spin may be communicated to the client. Mission progress may not (and/or may) be stored from one base game spin to the next base game spin, according to one embodiment.

Mission Category 1: Total Win×Bet. According to one embodiment, on each spin, item accumulated is the truncated integer value ((total win from game cycle after current spin)−(total win from game cycle before current spin))/(totalbet). In this example, the final prize is determined based on the sum of line wins from all spins in the game cycle, divided by the bet, rounded down to the nearest integer value, according to one embodiment.

Mission Category 2: Count of 7 symbols appearing. According to one embodiment, on each spin, the item accumulated is the total count of G7, S7, R7, and B7 symbols appearing. In this example, the final mission prize is determined based on the sum of the count of G7, S7, R7, and B7 symbols from all spins in the game cycle, according to one embodiment.

Mission Category 3: Total Count of Multipliers Appearing. According to one embodiment, on each spin, item accumulated is the number of incremental bonus multiplier (WB, W2×, W3×) symbols appearing. In this example, the final prize is determined based on the total count of bonus multiplier symbols appearing at the end of a game cycle, according to one embodiment.

Mission Category 4: Sum of Multiplier symbols appearing. According to one embodiment, on each spin, the item accumulated is the incremental sum of multipliers on bonus multiplier symbols (i.e. each WB counts as 1, each W2× counts as 2, each W3× counts as 3). In this example, the final mission prize is determined based on the sum of all bonus multiplier symbols appearing at the end of a game cycle, according to one embodiment.

Mission Category 5: Count of G7 symbols. According to one embodiment, on each spin, the item accumulated is the count of G7 symbols that appear. In this example, the final mission prize is determined based on the sum of the count of G7 symbols from all spins in the game cycle, according to one embodiment.

Variations of Mission Functionality. Missions may be prizes within N games, according to one embodiment. Mission progress is stored over N game rounds, according to one embodiment. Prize is evaluated and paid only after the Nth game round, according to one embodiment. Prize is awarded as a multiple floor of (highest integer less than or equal to) the average bet over the N game rounds, according to one embodiment. Any remained is stored in an "escrow" account and is added to the pay multiple for the following prize evaluation, according to one embodiment. Many other types of accumulations —any event in the game can be accumulated to be the basis for a mission prize, according to one embodiment. The prize for completing a mission may be an accumulated prize, jackpot, and/or entries in a prize drawing, according to one embodiment.

Promotional States—In each of the promotional states, a new paytable overrides the default paytable for some or all missions, for a specific time frame (between a defined start date and end date), according to one embodiment. When a promotional state is active, the start date, end date, and missions promotion configuration may be communicated to the client (as well as obviously that a promotional state is active), according to one embodiment. Promotional states can be enabled globally (for all users) or for select segments of users, according to one embodiment. Different promotional states can be active or different users or segments of users, according to one embodiment. The promotional states only affect the mission's paytable—not the game paytable, according to one embodiment. Operators can decide whether to self-manage the promotional states or use a global promotions schedule managed by Kalamba (e.g., third party) (we expect that the first operators will want to self-manage but with Kalamba's assistance), according to one embodiment. The system therefore comprises a back office component where Kalamba or an operator can enable the promotional state for: All users on all operators (casino sites); All users on specific operators; and/or Specific users on specific operators. There is meant to be an API for operators to schedule promos—for example if operators already have a tool used to schedule promotions, an interface exists for this engine to communicate a user ID, a start date, end date, and configuration to the Kalamba promotions database and use that to determine what promotions are eligible for a user upon loading the game, according to one embodiment. Each mission is meant to add about 1.5% (and/or any other percentage and/or amount) to the RTP of the game, according to one embodiment.

Specific Promo States—Promo State 1: Top Prize Blowout—The top (or top N) prizes for each mission paytable are increased throughout the mission, according to one embodiment. Promo State 2: Platinum & Silver Bonanza—The paytables for the platinum and silver level missions alone are increased for the duration of the promo state, according to one embodiment. Promo State 3: Free Rounds Bonanza—There is a free rounds prize added to the prize payout for select prizes in the mission, in all levels (defined according to a fixed specification), according to one embodiment.

Variations of Promotional States—Additional payouts, according to various embodiments. Pays for completing multiple missions, according to one embodiment. For example have a separate paytable that lasts over multiple game rounds and pays for completion of N missions, or M missions of Gold level or higher, according to one embodiment. Replacement of a fixed pay with a share of a jackpot prize proportional to total bet on one session or the average among multiple games, according to one embodiment. Missions award entries to a prize drawing that is made randomly at the end of the promotion period, according to one embodiment. Multiple missions in progress at a time, according to one embodiment. For example play for two missions simultaneously rather than one, according to one embodiment. Additional missions that are only available during a promotional state, according to one embodiment.

Promotional States for Standalone Progressive Jackpots—For a limited time, the configuration of the jackpot award changes in one or more of the following ways: The reset amount increases for a limited time (e.g. instead of 1000× bet for the reset amount, win up to 2000× bet); and/or the increment rate (the amount the jackpot increases per bet placed) increases for a limited time (e.g. instead of increasing by 2% of each bet, a jackpot increases by 4%), according to various embodiments.

Promotional States for Collection+Bonus Spins—Within the bonus feature games, one or several of the following items may be modified for a limited time to form the promotional state: The collection prize may award a different bonus game feature; one or several of the prizes within the bonus feature may be increased; and/or the number of symbols required to complete a collection may be reduced, according to various embodiments.

Standalone Progressive Jackpots—There is one or several personal progressive jackpot prize(s)—Each jackpot prize consists of 2 components: a reset amount (which is either a fixed amount or varies only in relation to the bet amount on a single spin such that it is multiplied in proportion to the bet), and an increment pool, which increases for each bet placed until the jackpot is awarded, and then it resets to 0 or a fraction of a coin/credit, which is represented as 0, according to one embodiment. Each progressive jackpot prize may be awarded by a combination of symbols—E.g. Count of symbols appearing on a single spin. In one example, some symbols may count as 2 or 3 instances of a symbol toward the total. In another example, symbols may substitute for other symbols in the count toward the total. In another example, symbol combinations appearing in a sequence on a pattern, such as a payline. In another example, symbol combinations appearing in specific positions on the reels, e.g. the center position. In another example, each progressive jackpot prize may be awarded for thresholds of collection in a bonus feature. In another example, within a free spins bonus, collect 5 items for bronze level, 7 items for silver level, 10 items for gold level, 12 items for platinum level; where items are awarded from symbols that appear during the free spins. In another example, each progressive jackpot may be awarded for a function within a bonus prize. In another example, a random selection, such as where a bonus feature is triggered, via a symbol combination, and the game randomly determines which progressive to award.

In another example, a wheel spin, where individual slices of the wheel represent a progressive jackpot award. In another example, each progressive jackpot may be awarded via a "lucky coin" functionality. In another example, the game determines the interval in coins/credits bet from the last jackpot hit to the next.

Collection+Bonus Spins—The game has one or several symbols that count towards a collection meter. In one example, when the collection meter is full, a player can play a bonus game feature which awards a prize. In some embodiments, the player can opt to continue collecting symbols and play the bonus when reaching a higher number of symbols collected. When the higher number of symbols is collected, in some embodiments the player plays the same bonus feature with higher prize values; in other embodiments, the player plays a different bonus feature. In another example, the bonus game feature can vary. In some embodiments, this bonus feature is a free spins or similar bonus, with a prize table for combinations of symbols on different reels. In other embodiments, this bonus feature may be a wheel spin, where the wheel spins and awards a prize. In other embodiments, this bonus feature may be a free spins or similar bonus where the objective is to collect symbols, which greater numbers of symbols awarding greater prizes.

Retention Marketing is Key to B2C Operations—The model for any B2C ecommerce business may be to acquire users via marketing activity, then maximize the value of these users (their lifetime value—LTV). This maximization effort may be performed along three pillars: Making users as highly engaged as possible while they are "active" (usually defined as having visited within N days). Maximizing monetization for engagement. Performing retention marketing activity to reactivate users that have dropped in their activity level. This feature is meant to increase all three pillars and therefore lead to a substantial jump in casino LTV for users that play games with this feature, according to one embodiment. Monetization for engaged users is increased by showing potential for very large prizes. Engagement of active users increased by providing a promotional system with limited duration, so users may maximize activity within a time period to be most eligible for prizes. The activation of promotional states allows for retargeting marketing campaigns to draw known users back into the online casino without having to give away free bonus cash, free game rounds, etc., and thereby increase net revenue.

Examples may be Combined—All examples, embodiments, and/or any other information in this disclosure may be combined with any other example, embodiment, and/or information regardless of where the example, embodiment, and/or information is located. For example, an example located on page one may be combined with another example located on the last page of this disclosure. Further, an example located on page two may be combined with an embodiment located on page ten.

What is claimed:

1. An electronic gaming device comprising:

a plurality of display areas;

one or more paylines formed on at least a portion of the plurality of display areas;

a memory, the memory including one or more mission game play structures and player profiles, where the player profiles include a first player profile, a second player profile, and an Nth player profile;

a processor configured to determine a player's level based on data from at least one of the first player profile, the second player profile, and the Nth player profile, where the player's level is determined by a gaming entity, the processor configured to determine a pool of missions available based on the determined player's level, the processor configured to automatically select and initiate at least one of: a) a first set of mission game play structures from the determined pool of missions available based on the determined first player level which is based on the first player profile; b) a second set of mission game play structures from the determined pool of missions available based on the determined second player level which is based on the second player profile; and c) a Nth set of mission game play structures from the determined pool of missions available based on the determined Nth player level which is based on the Nth player profile, where the first set of mission game play structures is different than the second set of mission game play structures and the Nth set of mission game play structures based on the determined player's level being utilized for the first set of mission game play structure;

wherein the processor is configured to determine a mission outcome for a mission game play and display a mission status on a mission meter.

2. The electronic gaming device of claim 1, wherein an initiated mission game play structure is based on one or more criteria selections.

3. The electronic gaming device of claim 1, wherein an initiated mission game play structure is based on a selection by a player.

4. The electronic gaming device of claim 1, wherein a mission achievement carries over to a next game play.

5. The electronic gaming device of claim 1, wherein a mission achievement is reset to a baseline for a next game play.

6. The electronic gaming device of claim 1, wherein the one or more mission game play structures are tied to one or more mission levels.

7. The electronic gaming device of claim 6, wherein a first mission, a second mission, and a third mission are in a first mission level, a fourth mission, a fifth mission, and a sixth mission are in a second mission level, and a seventh mission, an eighth mission, and an N-1 mission are in a Nth mission level.

8. The electronic gaming device of claim 7, wherein the processor is configured to initiate the second mission level based on the first mission, the second mission, and the third mission being completed, the processor further configured to initiate the Nth mission level based on the first mission, the second mission, the third mission, the fourth mission, the fifth mission, and the sixth mission being completed.

* * * * *